US011581677B2

(12) United States Patent
Kobayashi et al.

(10) Patent No.: US 11,581,677 B2
(45) Date of Patent: Feb. 14, 2023

(54) CONNECTOR PROTECTION MEMBER AND CONNECTOR

(71) Applicant: HIROSE ELECTRIC CO., LTD., Kanagawa (JP)

(72) Inventors: Yuki Kobayashi, Kanagawa (JP); Junho Kim, Kanagawa (JP); Kouhei Oda, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 8 days.

(21) Appl. No.: 17/504,987

(22) Filed: Oct. 19, 2021

(65) Prior Publication Data

US 2022/0131306 A1 Apr. 28, 2022

(30) Foreign Application Priority Data

Oct. 27, 2020 (JP) ..... JP2020-179430

(51) Int. Cl.
*H01R 13/504* (2006.01)
*H01R 12/71* (2011.01)

(52) U.S. Cl.
CPC ..... *H01R 13/504* (2013.01); *H01R 12/716* (2013.01)

(58) Field of Classification Search
CPC ..... H01R 12/73; H01R 12/716; H01R 13/20; H01R 13/504; H01R 24/60
See application file for complete search history.

(56) References Cited

U.S. PATENT DOCUMENTS 10,868,378 B2 * 12/2020 Ko ..... H01R 12/707
11,367,976 B2 * 6/2022 Hosoda ..... H01R 24/60
2006/0264075 A1 11/2006 Obikane et al.
2016/0036145 A1 * 2/2016 Hasegawa ..... H01R 12/7076 439/78
2017/0264048 A1 9/2017 Ashibu et al.
2021/0320444 A1 * 10/2021 Lee ..... H01R 12/775

FOREIGN PATENT DOCUMENTS

JP 2006-331679 A 12/2006
JP 2017-168210 A 9/2017

* cited by examiner

*Primary Examiner* — Oscar C Jimenez
(74) *Attorney, Agent, or Firm* — Rankin, Hill & Clark LLP

(57) ABSTRACT

Provided is a connector protection member for protecting a connector. The connector includes a housing having a center raised portion including a raised portion end wall, a raised portion end side wall, and a raised portion end upper surface connecting the raised portion end wall, and the raised portion end side wall. A raised portion side surface protection portion of the connector protection member includes: a side portion covers part of the raised portion end wall and part of the raised portion end side wall, and a transition portion formed continuously to the side portion covers a three-surface connection portion formed by an end wall connection portion between the raised portion end wall and the raised portion end upper surface and a side wall connection portion between the raised portion end side wall and the raised portion end upper surface.

7 Claims, 19 Drawing Sheets

CONNECTOR PROTECTION MEMBER AND CONNECTOR

CROSS-REFERENCE TO RELATED APPLICATION

This application claims priority from Japanese Patent Application No. 2020-179430 filed with the Japan Patent Office on Oct. 27, 2020, the entire content of which is hereby incorporated by reference.

BACKGROUND

1. Technical Field

The present disclosure relates to a connector protection member configured to protect a connector and a connector.

2. Related Art

For a small electronic device such as a wearable device such as wireless earphones or smart glasses or a mobile device such as a laptop computer, a smartphone, or a tablet, reduction in the size of a component used for the electronic device has been continuously demanded. Further size reduction has been also demanded for a connector as part of components. Meanwhile, a housing of the connector becomes easily damageable due to size reduction.

JP-A-2006-331679 discloses receptacle members 141, 142, 241, 242 for reducing damage of a housing (FIGS. 3 and 4). As understood from FIG. 2, a lateral side surface of a center protruding portion in a receptacle-side housing 121, part of a longitudinal side surface formed continuously to the lateral side surface, and part of an upper surface of the center protruding portion formed continuously to the lateral side surface are protected by the receptacle members.

JP-A-2017-168210 also discloses a protection portion 410 for reducing damage of a housing (FIGS. 7 and 8). As understood from FIG. 1, a lateral side surface of a center protruding portion in a receptacle-side housing and part of an upper surface of the center protruding portion formed continuously to the lateral side surface are protected by the protection portion 410.

SUMMARY

A connector protection member according to an embodiment of the present disclosure is for protecting a connector, the connector protection terminal being configured such that the connector includes a housing having a center raised portion including at least a raised portion end wall having a plane formed by a connector depth direction and a connector height direction, a first raised portion end side wall having a plane formed by a connector width direction and the connector height direction, a second raised portion end side wall parallel with the first raised portion end side wall, and a raised portion end upper surface connecting the raised portion end wall, the first raised portion end side wall, and the second raised portion end side wall to each other and having a plane formed by the connector width direction and the connector depth direction. The connector protection member is configured to include: a raised portion side surface protection portion having a side portion and a transition portion formed continuously to the side portion, in which the side portion covers at least part of the raised portion end wall and at least part of one or both of the first raised portion end side wall and the second raised portion end side wall, and the transition portion covers at least one of a first three-surface connection portion formed by an end wall connection portion between the raised portion end wall and the raised portion end upper surface and a first side wall connection portion between the first raised portion end side wall and the raised portion end upper surface or a second three-surface connection portion formed by the end wall connection portion and a second side wall connection portion between the second raised portion end side wall and the raised portion end upper surface.

DETAILED DESCRIPTION

Figure 1A:
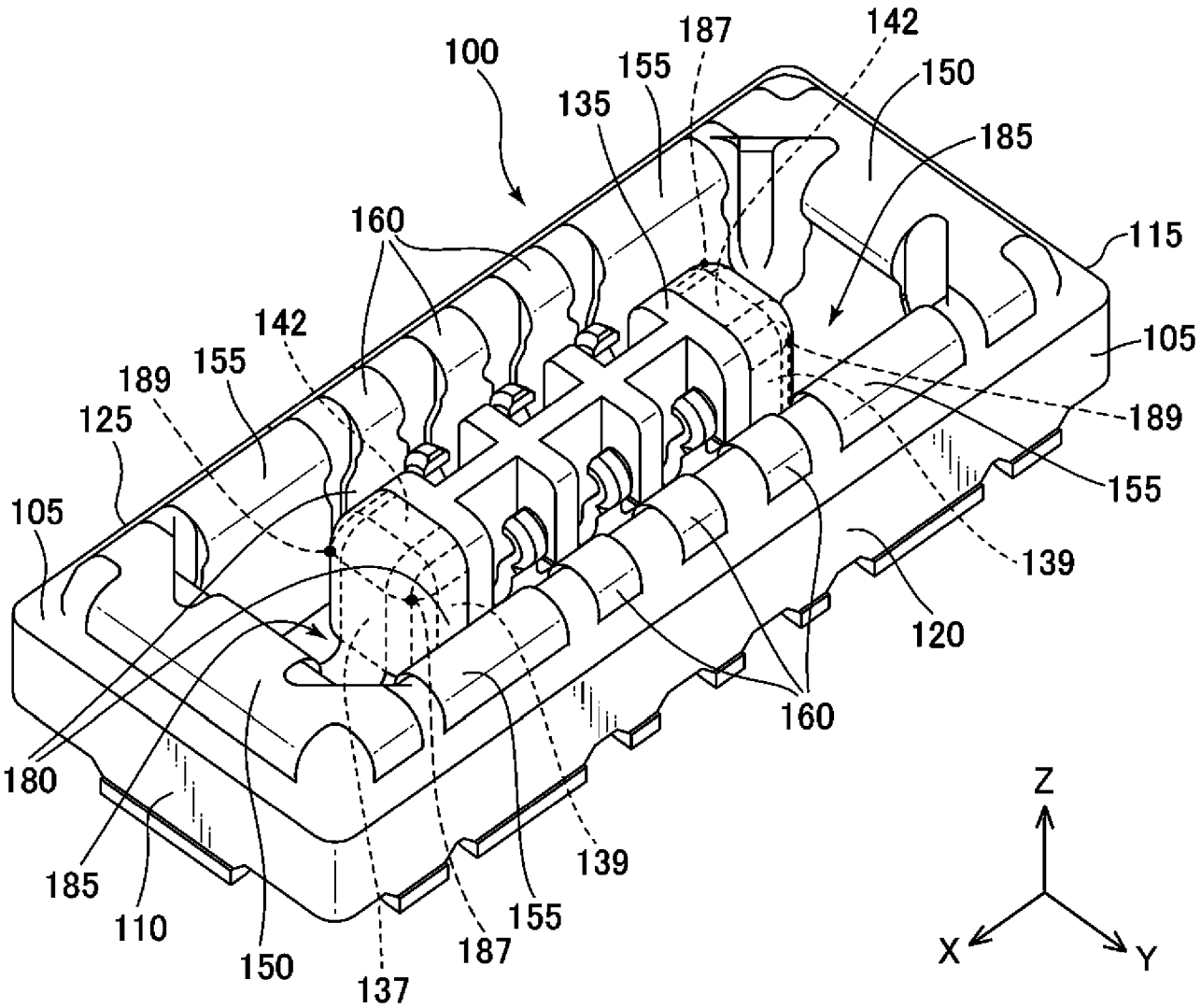
FIG. 1A is a perspective view of a connector from above.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the connectors of JP-A-2006-331679 and JP-A-2017-168210, the protection member fails to protect not only a three-surface connection portion formed by the upper surface, the longitudinal side surface, and the lateral side surface of the center protruding portion of the housing but also a longitudinal upper surface connection portion connecting the upper surface and the longitudinal side surface of the center protruding portion of the housing. In these techniques, a lateral upper surface portion is protected. However, upon fitting of the connector, a longitudinal upper surface portion also frequently contacts a partner connector as in the lateral upper surface portion. Thus, the longitudinal upper surface portion is also damaged due to contact with the partner connector in some cases. Due to such damage, a problem such as short-circuit is caused.

A protection member for improving protection of a center raised portion end portion in a housing of a connector to reduce damage of the housing is provided.

A connector protection member according to the embodiment of the present disclosure is a connector protection member for protecting a connector, in which the connector including a housing having a center raised portion including at least a raised portion end wall having a plane formed by a connector depth direction and a connector height direction, a first raised portion end side wall having a plane formed by a connector width direction and the connector height direction, a second raised portion end side wall parallel with the first raised portion end side wall, and a raised portion end upper surface connecting the raised portion end wall, the first raised portion end side wall, and the second raised portion end side wall to each other and having a plane formed by the connector width direction and the connector depth direction. The connector protection member includes a raised portion side surface protection portion having a side portion and a transition portion formed continuously to the side portion, the side portion can cover at least part of the raised portion end wall and at least part of one or both of the first raised portion end side wall and the second raised portion end side wall, and the transition portion can cover at least one of a first three-surface connection portion formed by an end wall connection portion between the raised portion end wall and the raised portion end upper surface and a first side wall connection portion between the first raised portion end side wall and the raised portion end upper surface or a second three-surface connection portion formed by the end wall connection portion and a second side wall connection portion between the second raised portion end side wall and the raised portion end upper surface.

Figure 1B:
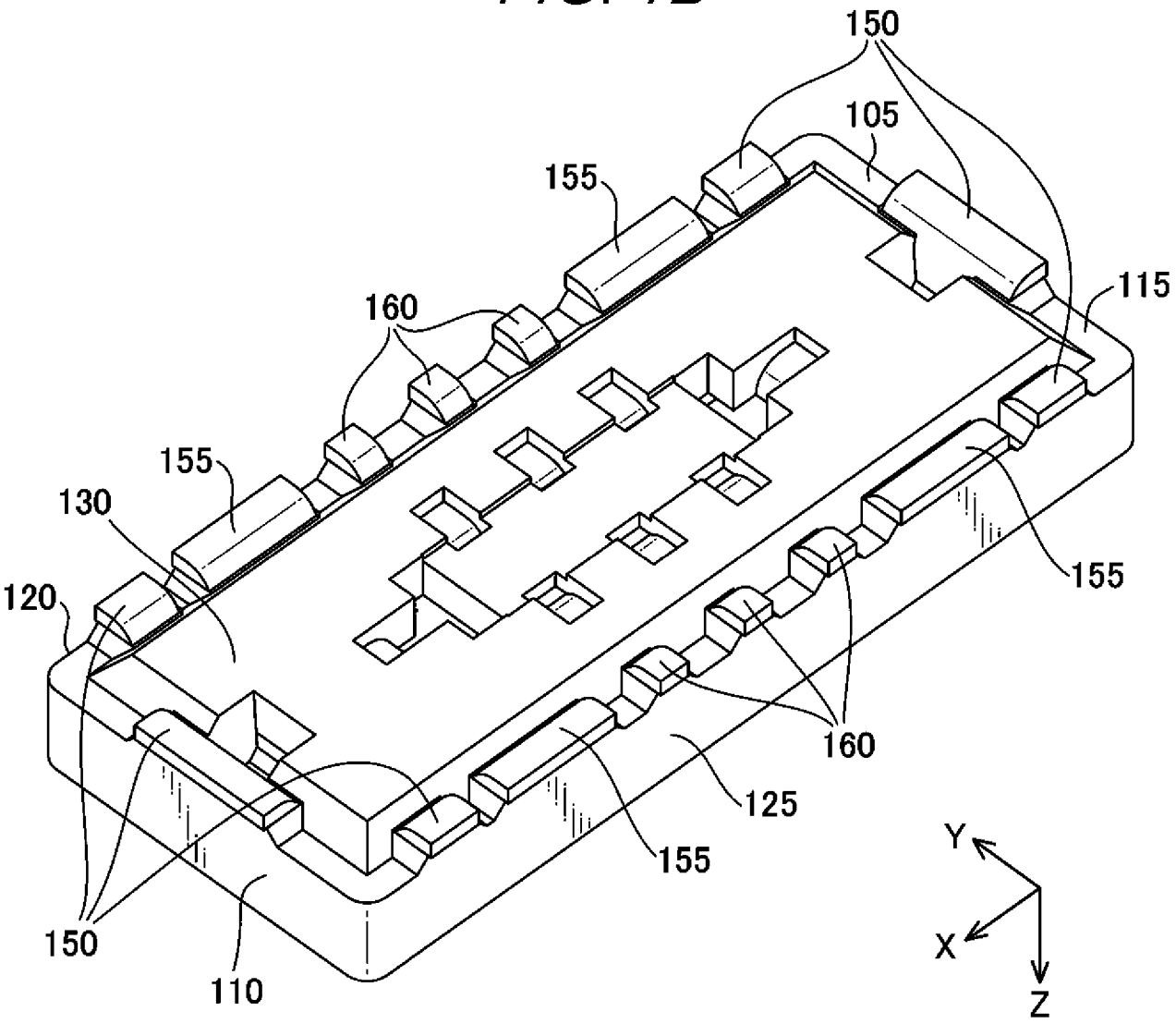
FIG. 1B is a perspective view of the connector from below.
Figure 1C:
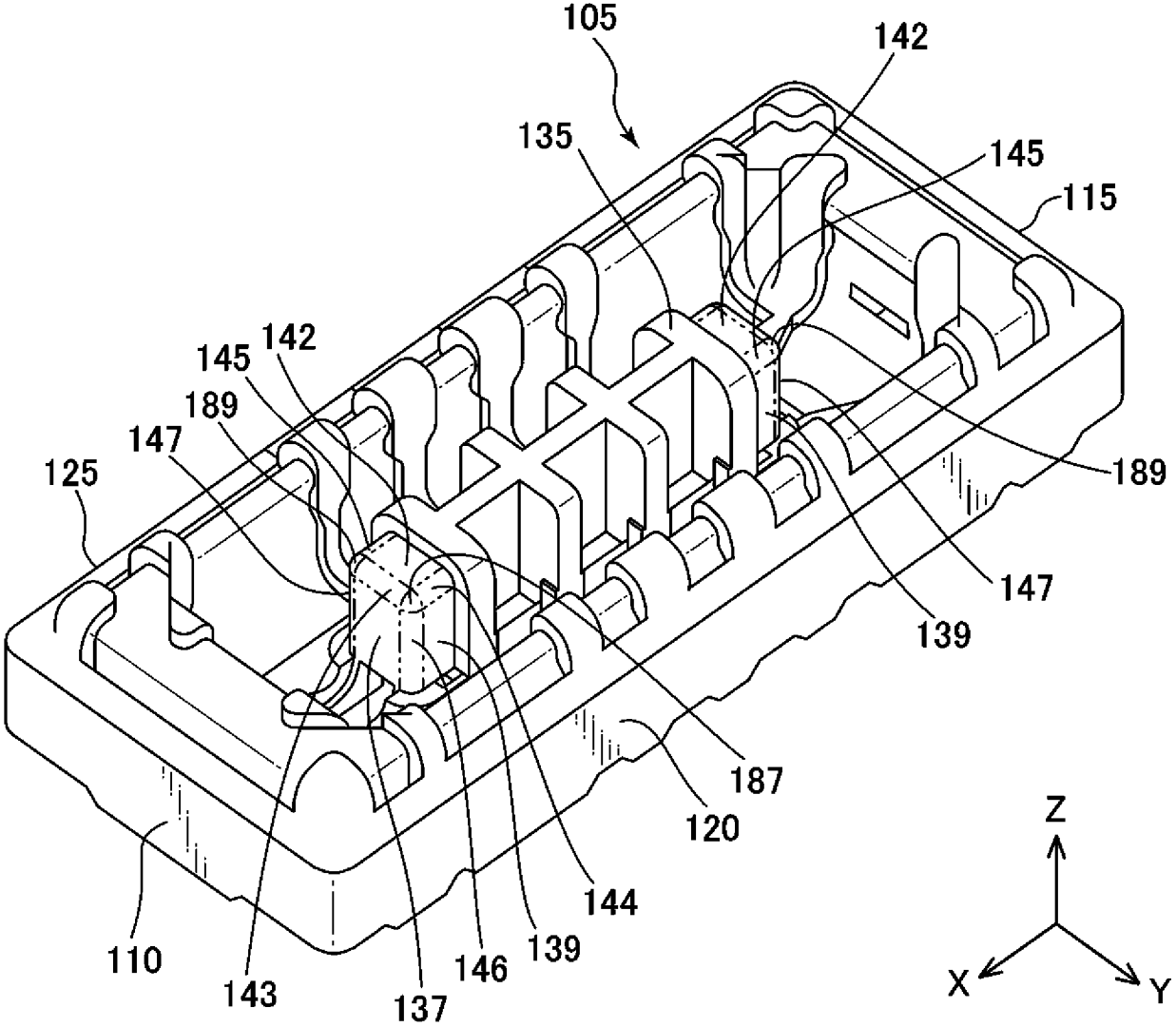
FIG. 1C is a perspective view of a housing of the connector from above.

FIG. 1A shows a perspective view of a connector 100 from above. FIG. 1B shows a perspective view of the connector 100 from below. FIG. 1C shows a perspective view of a housing 105 of the connector 100 from above as in FIG. 1A. The connector 100 includes the housing 105 formed using an insulating member such as resin, protection members 150, power terminals 155, and signal terminals 160. The housing 105 has a first end wall 110 extending in a Y-direction, a second end wall 115 extending parallel with the first end wall 110, a first side wall 120 formed continuously to the first end wall 110 and the second end wall 115, a second side wall 125 formed parallel with the first side wall 120 and formed continuously to the first end wall 110 and the second end wall 115, a bottom wall 130 (see FIG. 1B), and a center raised portion 135 formed in an island shape at the center. Note that X, Y, and Z shown in FIG. 1A and the later-described figures each indicate the directions of corresponding axes. As necessary, "+" indicating the positive direction of each axis or "−" indicating the negative direction of each axis is assigned to X, Y, and Z in some cases.

The protection members 150 are held in such a manner that the protection members 150 are insert-molded (molded integrally) with the housing 105. The protection members 150 are arranged at the peripheries of the first end wall 110 and the second end wall 115. The protection member 150 can be preferably made of a material harder than that of the housing 105, and more preferably, can be a metal plate for which, e.g., bending or drawing can be performed. In one embodiment, the protection member 150 may be a conductive member.

The power terminal 155 and the signal terminal 160 are formed of conductive members. The power terminal 155 can be used as a power terminal to which a greater power than that for a signal terminal is to be applied, and can have a greater width in an X-direction than that of the signal terminal 160. The signal terminals 160 are arranged in two lines at the same pitch in the X-direction. In other embodiments, the signal terminals 160 may be arranged in a single line or three or more lines in the X-direction, and the pitch width thereof in the X-direction is not necessarily the same pitch width and may be different pitch widths. In other embodiments, the power terminals 155 and the signal terminals 160 may be placed at positions other than the illustrated positions.

The housing 105 has a groove-shaped partner connector housing portion 180 having the bottom wall 130 as a bottom surface and formed among the center raised portion 135, the first end wall 110, the second end wall 115, the first side wall 120, and the second side wall 125. The partner connector housing portion 180 as a groove formed at the periphery of the center raised portion 135 as described above has fitting portions 185 in the vicinity of the first end wall 110 and the second end wall 115. The fitting portions 185 are used for housing a partner connector 200 such that the connector 100 and the partner connector 200 are fitted to each other. The center raised portion 135 has, at each end portion or one end portion thereof, an end surface at least partially covered with the protection member 150. As understood from FIGS. 1A and 1C, the end surfaces of the center raised portion 135 covered with the protection members 150 are formed at both end portions of the center raised portion 135. The end surface of the center raised portion 135 covered with the protection member 150 is formed by four walls or surfaces including a raised portion end wall 137 forming a surface parallel with a YZ plane, a pair of raised portion end side walls 139 formed continuously to the raised portion end wall 137 and forming surfaces parallel with an XZ plane, and a raised portion end upper surface 142 formed continuously to the raised portion end wall 137 and forming a surface parallel with an XY plane. The raised portion end side walls 139 in a pair face each other at least at the end portion of the center raised portion 135 covered with the protection member 150. The end portion of the center raised portion 135 in the housing 105 has the four walls (surfaces) including the raised portion end wall 137, the pair of raised portion end side walls 139, and the raised portion end upper surface 142, an end wall connection portion 143, a first side wall connection portion 144, a first end wall side wall connection portion 146, a first three-surface connection portion (a first corner portion) 187, a second side wall connection portion 145, a second end wall side wall connection portion 147, and a second three-surface connection portion (a second corner portion) 189. The end wall connection portion 143 connects the raised portion end wall 137 and the raised portion end upper surface 142 to each other. The first side wall connection portion 144 connects one of the raised portion end side walls 139 and the raised portion end upper surface 142 to each other. The first end wall side wall connection portion 146 connects the raised portion end wall 137 and the one of the raised portion end side walls 139 to each other. The first three-surface connection portion (the first corner portion) 187 connects the end wall connection portion 143, the first side wall connection portion 144, and the first end wall side wall connection portion 146 to each other. The second side wall connection portion 145 connects the other raised portion end side wall 139 and the raised portion end upper surface 142 to each other. The second end wall side wall connection portion 147 connects the raised portion end wall 137 and the other raised portion end side wall 139 to each other. The second three-surface connection portion (the second corner portion) 189 connects the end wall connection portion 143, the second side wall connection portion 145, and the second end wall side wall connection portion 147 to each other. The first three-surface connection portion 187 and the second three-surface connection portion 189 are ones of locations where damage is most likely to occur due to collision between the connector 100 and the partner connector 200 when the connector 100 is fitted onto the partner connector 200. Moreover, the first end wall side wall connection portion 146 and the second end wall side wall connection portion 147 are also ones of the locations where the damage is likely to occur when the connector 100 is fitted onto the partner connector 200.

At least part of the protection member 150 faces the end surface of the center raised portion 135. Preferably, at least part of the protection member 150 contacts the end surface of the center raised portion 135. More preferably, at least part of the protection member 150 closely contacts the end surface of the center raised portion 135. The protection member 150 contacts, faces, or closely contacts the end surface of the center raised portion 135, and in this manner, is held on the housing 105. In other embodiments, the protection member 150 may be held on the housing 105 by combination of at least two or more of the protection member 150 facing the end surface of the center raised portion 135, contacting the end surface, or closely contacting the end surface.

As understood from FIG. 1B, part of the protection member 150 is exposed at a back surface of the bottom wall 130. In a case where the connector 100 is produced by insert molding, a surface of the exposed portion of the protection member 150 can be substantially flush with the surface of the bottom wall 130.

The signal terminals 160 and the power terminals 155 exposed through the housing 105 shown in FIG. 1B are connected to a substrate (not shown in the figure) in an electronic device by, e.g., soldering.

Figure 2A:
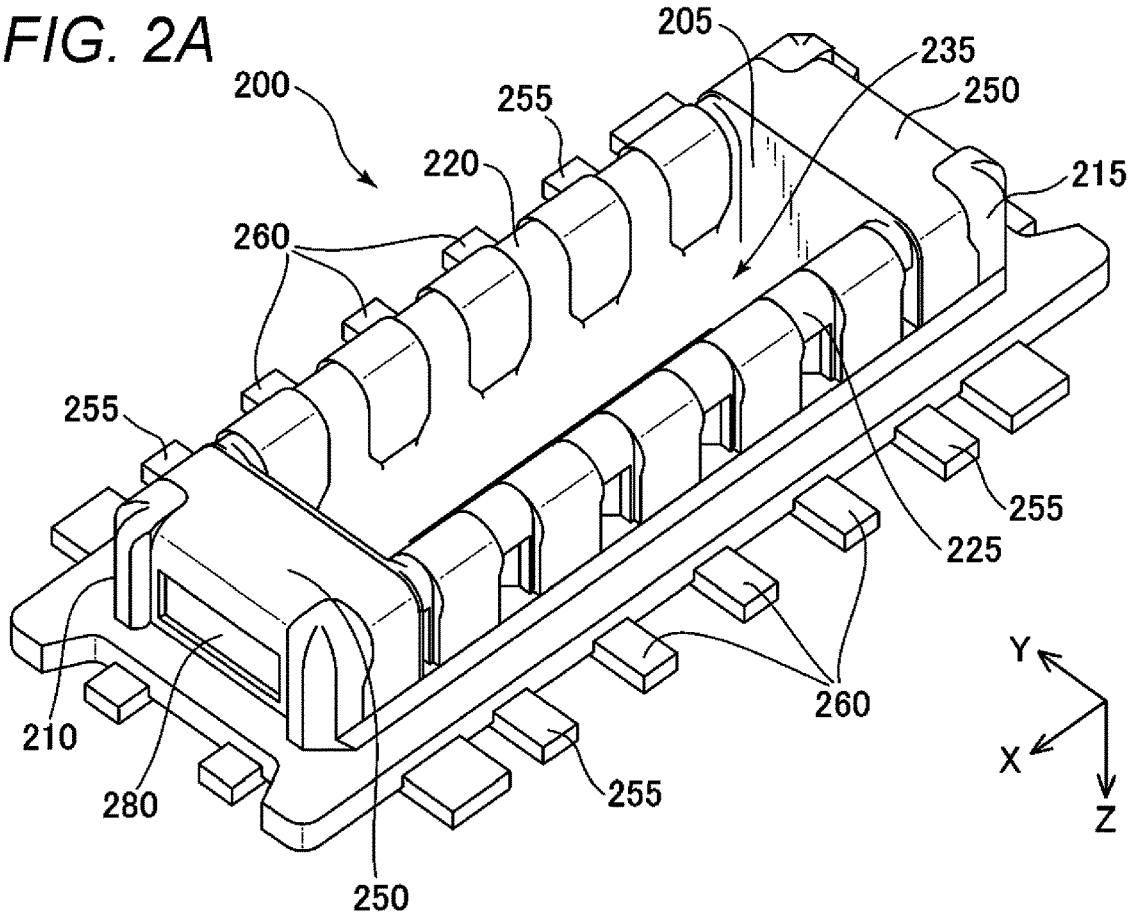
FIG. 2A is a perspective view of a partner connector from above.
Figure 2B:
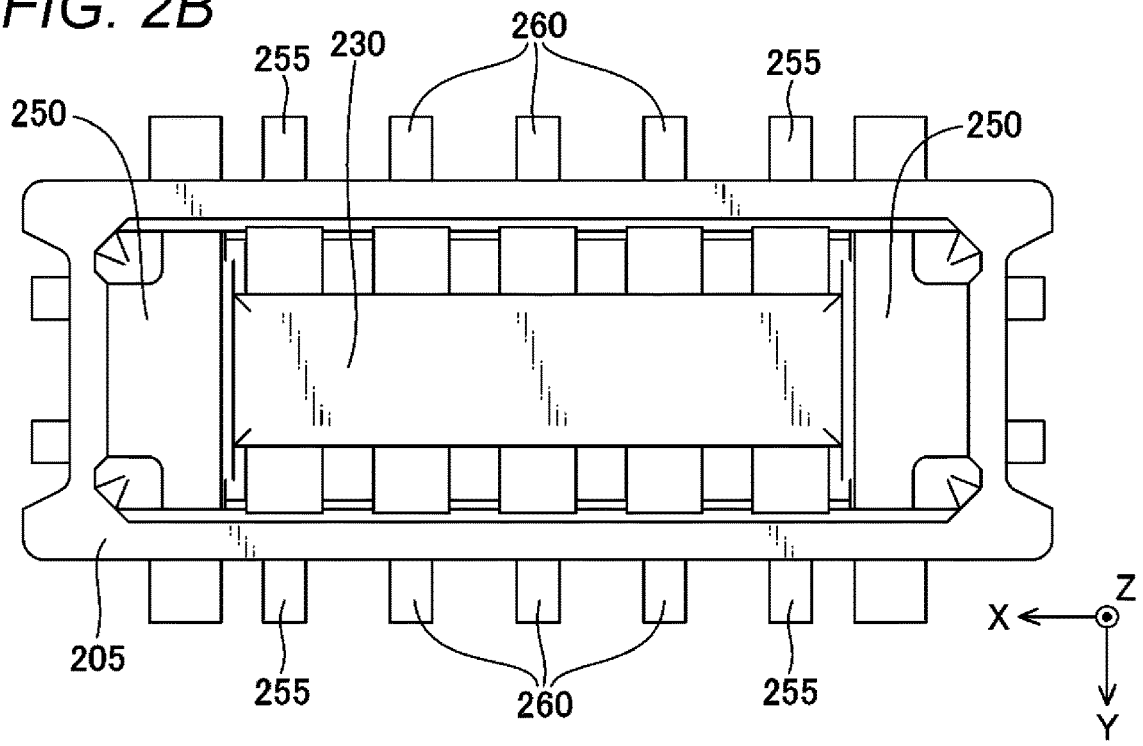
FIG. 2B is a perspective view of the partner connector from below.

FIG. 2A shows a perspective view of the partner connector 200 from above. FIG. 2B shows a perspective view of the partner connector 200 from below. The partner connector 200 includes, corresponding to the connector 100, a housing 205 formed using an insulating member such as resin, protection members 250, power terminals 255, and signal terminals 260. The housing 205 has a first end wall 210 extending in the Y-direction, a second end wall 215 extending parallel with the first end wall 210, a first side wall 220 formed continuously to the first end wall 210 and the second end wall 215, a second side wall 225 formed parallel with the first side wall 220 and formed continuously to the first end wall 210 and the second end wall 215, and a bottom wall 230 (see FIG. 2B). At the center of the partner connector 200, the first end wall 210, the second end wall 215, the first side wall 220, the second side wall 225, and the bottom wall 230 form a center recessed portion 235 in a recessed shape. The protection member 250 of the partner connector 200 has a locking target portion 280 to be locked at a later-described locking portion 310-3 of the connector 100. The locking target portion 280 is in a shape corresponding to the locking portion 310-3, and is formed as a recess or a hole at the protection member 250.

Figure 3A:
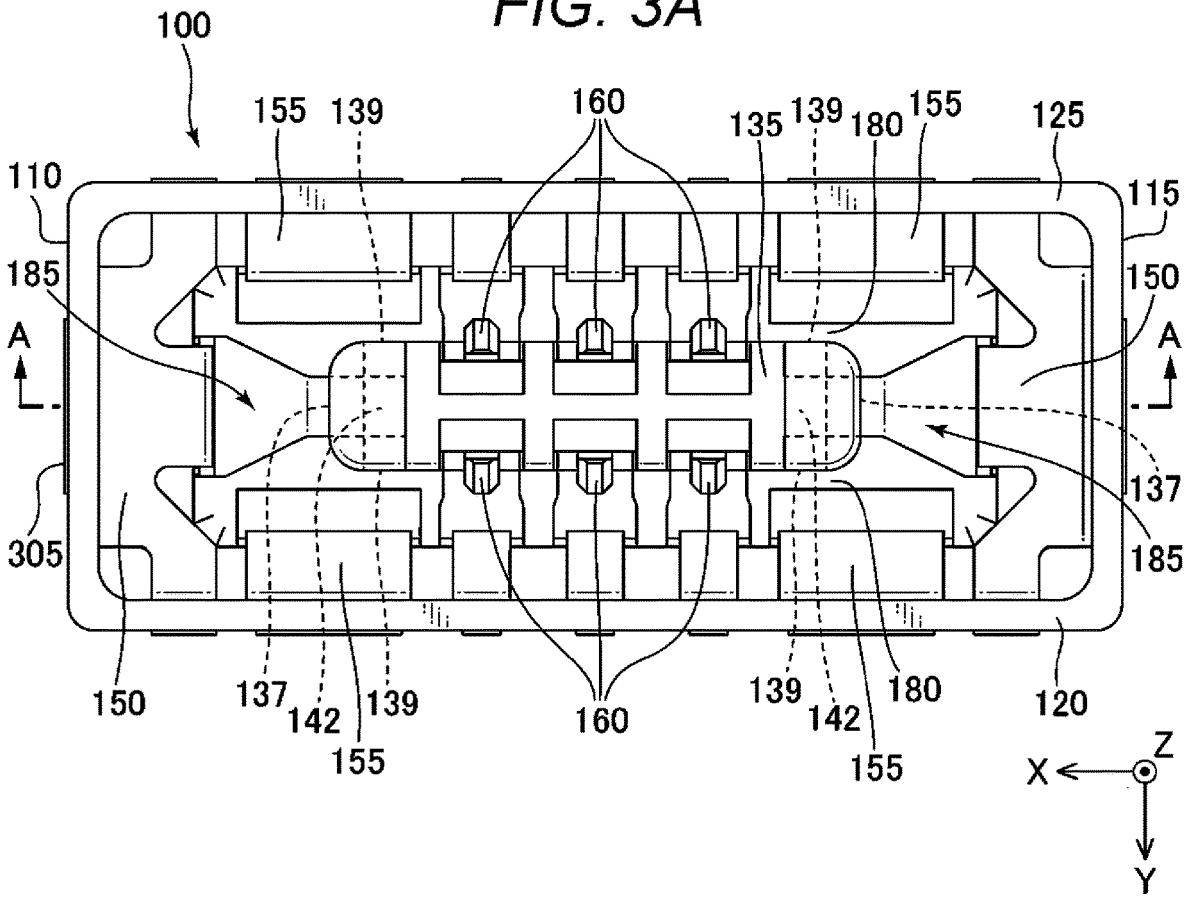
FIG. 3A is a view of the connector from above.
Figure 3B:
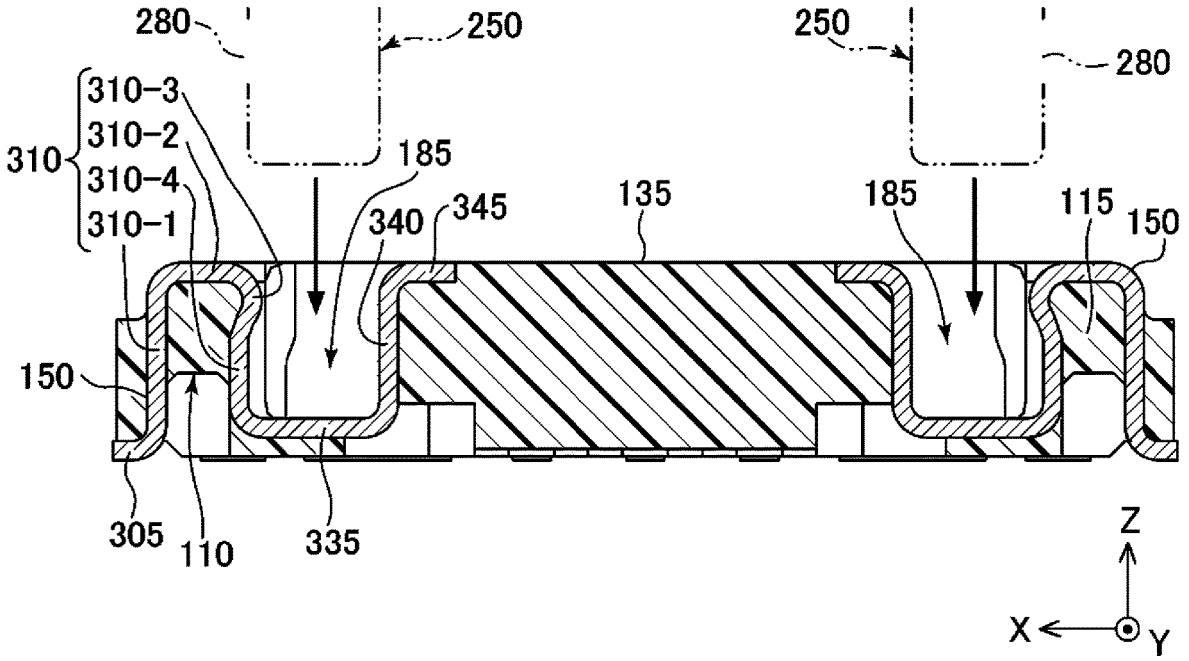
FIG. 3B is a sectional view of the connector along a line connecting characters "A" shown in FIG. 3A, and is the view from the direction of an arrow shown in FIG. 3A.

Referring to FIGS. 1A and 3B, it shows that the center raised portion 135 of the connector 100 is in a shape corresponding to the center recessed portion 235 of the partner connector 200 and the connector 100 houses the partner connector 200. By fitting between the connector 100 and the partner connector 200, the power terminals 155 and the signal terminals 160 of the connector 100 are each connected to the power terminals 255 and the signal terminals 260 of the partner connector 200, and electric connection between the connector 100 and the partner connector 200 is made accordingly.

FIG. 3A is a view of the connector 100 from above. FIG. 3B shows the connector 100, is a sectional view along a line connecting characters "A" shown in FIG. 3A, and shows the view from the direction of an arrow shown in FIG. 3A.

Referring to FIG. 3B, the protection member 150 has, at the first end wall 110, an end wall exposed portion 305 exposed to the outside of the housing 105. The end wall exposed portion 305 protrudes from the housing 105 in a −Z-direction (a bottom wall 130 side (see FIG. 1B)). The end wall exposed portion 305 may be, as a fixed portion, fixed to the substrate (not shown in the figure) by, e.g., soldering. The end wall exposed portion 305 extends in an inward direction of the connector 100, and is formed continuously to a curved substantially inverted U-shaped holding target portion 310. The holding target portion 310 has an outer holding target portion 310-1 extending in the +Z-direction from the end wall exposed portion 305, a curved holding target portion 310-2 forming a U-shaped bottom portion, the locking portion 310-3, and an inner holding target portion 310-4 extending in a −Z-direction from the locking portion 310-3. The locking portions 310-3 lock the locking target portions 280 (see FIG. 2B) of the partner connector 200, and accordingly, the connector 100 and the partner connector 200 are fixed to each other.

With the curve of the curved holding target portion 310-2, the outer holding target portion 310-1 and the inner holding target portion 310-4 face each other substantially in the X-direction (on the YZ plane). The inner holding target portion 310-4 is formed continuously to a coupling portion 335 arranged on the XY plane. The coupling portion 335 is formed continuously to a raised portion side surface protection portion 340. The raised portion side surface protection portion 340 is formed continuously to a raised portion upper surface protection portion 345. The raised portion side surface protection portion 340 and the raised portion upper surface protection portion 345 form a protection portion. In the embodiment of the present disclosure, the raised portion side surface protection portion 340 and the raised portion upper surface protection portion 345 or the raised portion side surface protection portion 340 has no joint. Preferably, there is no joint across the entirety of the protection member 150. Thus, as understood from FIGS. 1A to 1C, the raised portion side surface protection portion 340 and the raised portion upper surface protection portion 345 can cover the first three-surface connection portion 187 and the second three-surface connection portion 189 of the end portion of the center raised portion 135 such that the first three-surface connection portion 187 and the second three-surface connection portion 189 are not visually recognized from any of the X-direction, the Y-direction, and the Z-direction. In other embodiments, the raised portion side surface protection portion 340 and the raised portion upper surface protection portion 345 may be configured to cover only one of the first three-surface connection portion 187 or the second three-surface connection portion 189. In the present embodiment, the first three-surface connection portion 187 and the second three-surface connection portion 189 of the end portion of the center raised portion 135 are covered with the protection member 150, and are not visually recognized accordingly. This does not mean that the first three-surface connection portion 187 and the second three-surface connection portion 189 are covered with a member other than the protection member 150. For example, a configuration in which, e.g., at least one of the first end wall 110, the second end wall 115, the first side wall 120, or the second side wall 125 of the housing 105 covers, as the member other than the protection member 150, the first three-surface connection portion 187 and the second three-surface connection portion 189 such that the first three-surface connection portion 187 and the second three-surface connection portion 189 are not visually recognized is different from the configuration of the present disclosure.

The protection member 150 at the second end wall 115 is arranged reflection-symmetrically to the protection member 150 at the first end wall 110. In the other embodiments, the protection member 150 may be arranged only at one of the first end wall 110 or the second end wall 115.

In the present embodiment, the holding target portion 310 is in the substantially inverted U-shape, but as other embodiments, may be in other shapes such as a substantially inverted L-shape and a substantially inverted J-shape as long as the housing 105 can hold the holding target portion 310. In a case where the holding target portion 310 is in the substantially inverted L-shape or the substantially inverted J-shape, the protection member 150 can be configured without the end wall exposed portion 305, can be configured without the outer holding target portion 310-1 and the end wall exposed portion 305, or can be configured without part of the outer holding target portion 310-1 and the end wall exposed portion 305.

In other embodiments, the protection member 150 does not necessarily include the locking portion 310-3. In this case, the curved holding target portion 310-2 is directly connected to the inner holding target portion 310-4.

First Embodiment

A first embodiment will be described using FIGS. 4A to 4F. The first embodiment relates to a protection member 150 covering an end side of a center raised portion 135. FIGS. 4A to 4F show the protection member 150 from various angles.

Figure 4A:
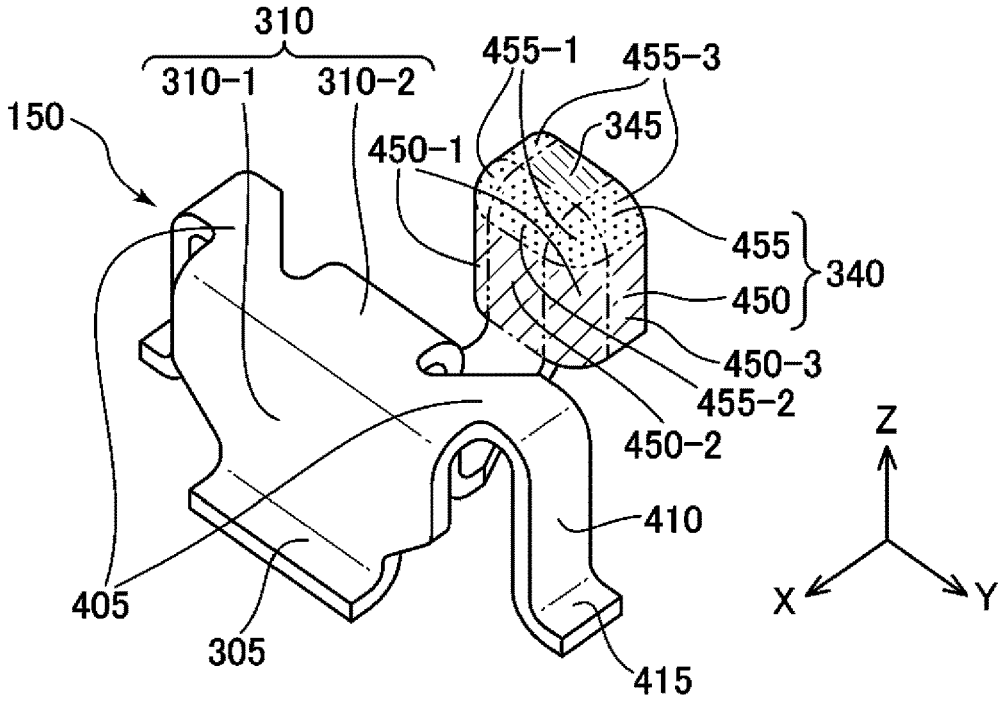
FIG. 4A is a protection member according to a first embodiment from various angles.

In FIG. 4A, an end wall exposed portion 305 is formed continuously to an outer holding target portion 310-1. By insert molding, part (mainly portions forming an XY plane and a YZ plane) of the outer holding target portion 310-1 is covered with a first end wall 110 (or a second end wall 115) of a housing 105 as shown in FIG. 1A. The outer holding target portion 310-1 is formed continuously to a curved holding target portion 310-2, and the curved holding target portion 310-2 is curved along an upper surface of the first end wall 110 (or the second end wall 115). The curved holding target portion 310-2 is formed continuously to an inner holding target portion 310-4 (also see FIG. 4B) through a locking portion 310-3. An end portion (a portion arranged in the vicinity of a first side wall 120 or a second side wall 125) of the outer holding target portion 310-1 in the Y-direction is, at a portion curved along an upper surface of the first side wall 120 or the second side wall 125, formed continuously to a side wall holding target portion 410 through a side wall coupling portion 405. The portion, which is curved along the upper surface of the first side wall 120 or the second side wall 125, of the end portion of the outer holding target portion 310-1 in the Y-direction and the side wall coupling portion 405 are not covered with the housing 105. The side wall holding target portion 410 is covered with the first side wall 120 (or the second side wall 125) of the housing 105 (see FIG. 1A). As described above, at least part of each of the outer holding target portion 310-1 and the side wall holding target portion 410 is covered with the housing 105, and accordingly, the protection member 150 is held on the housing 105. The side wall holding target portion 410 is formed continuously to a side wall fixing portion 415 forming the XY plane at a bottom portion of the protection member 150. The side wall fixing portion 415 may be fixed to, e.g., a substrate by soldering or other methods. A connector 100 can be produced by insert molding. In this case, bottom surfaces of the end wall exposed portion 305 and the side wall fixing portions 415 or part thereof is formed on the substantially same plane as (substantially flush with) a bottom surface of the housing 105. In other embodiments, a pair of side wall coupling portion 405 and side wall holding target portion 410 is not necessarily arranged on each of the first side wall 120 and the second side wall 125 as shown in FIGS. 4A and 4B, but may be arranged only on one of the first side wall 120 or the second side wall 125.

Figure 4B:
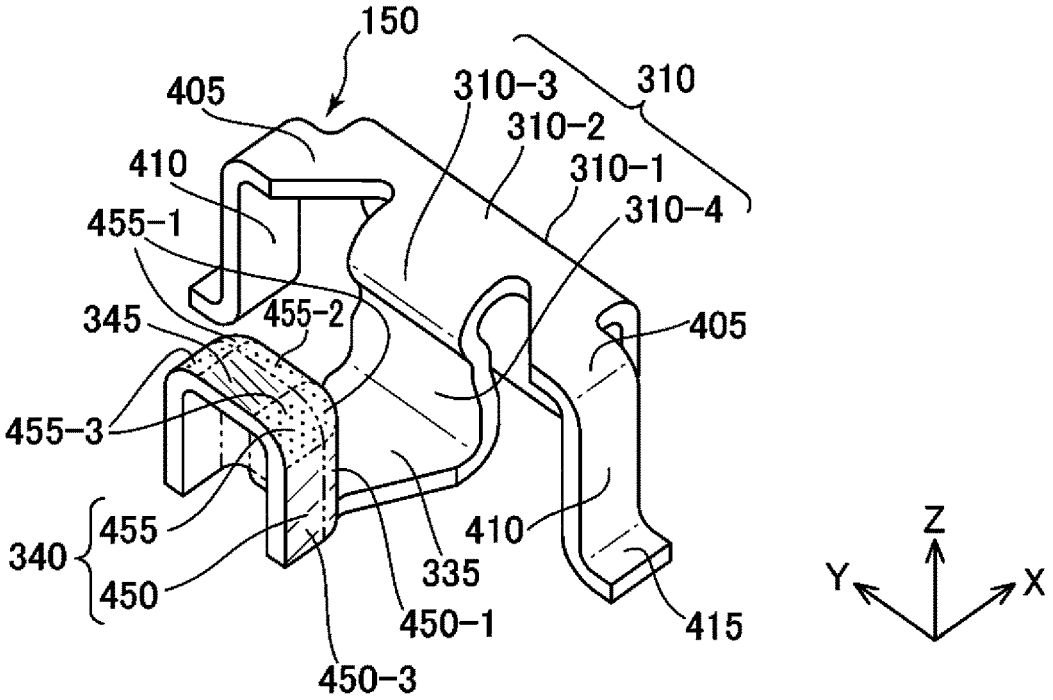
FIG. 4B is the protection member according to the first embodiment from various angles.

In FIG. 4B, the inner holding target portion 310-4 is formed continuously to a coupling portion 335. The inner holding target portion 310-4 and the coupling portion 335 are not covered with the housing 105, and are exposed at an upper surface of the housing 105 (also see FIGS. 1A and 3A). In other embodiments, the coupling portion 335 may be covered with the housing 105, and may be exposed at the bottom surface (a surface shown as an upper surface in FIG. 1B) of the housing 105. Alternatively, the coupling portion 335 may be covered with the housing 105, and is not necessarily exposed at the bottom surface of the housing 105.

In FIGS. 4A and 4B, a holding target portion 310 is, through the coupling portion 335, formed continuously to a first end wall 110 side or a second end wall 115 side of a raised portion side surface protection portion 340. The raised portion side surface protection portion 340 has a side portion 450 and a transition portion 455. The side portion 450 of the raised portion side surface protection portion 340 covers a raised portion end wall 137 of the center raised portion 135 of the housing 105 and at least part of a pair of raised portion end side walls 139 of the center raised portion 135 of the housing 105. Of the side portion 450, portions protecting portions transitioning from the raised portion end wall 137 to the pair of raised portion end side walls 139 may be curved. That is, the side portion 450 is, at portions protecting the raised portion end wall 137 and the pair of raised portion end side walls 139, parallel with the YZ plane and an XZ plane. Meanwhile, the side portion 450 is, at the portions protecting the portions transitioning from the raised portion end wall 137 to the pair of raised portion end side walls 139, formed such that the direction of a plane is changed from the YZ plane to the XZ plane. Regarding such a change in the plane direction, the curve is an example, and bending at a right angle may be employed. Of the side portion 450, the portions protecting the portions transitioning from the raised portion end wall 137 to the pair of raised portion end side walls 139 can protect connection portions (substantially right-angled portions at which the YZ plane and the XZ plane cross each other) at which the raised portion end wall 137 and the pair of raised portion end side walls 139 are connected to each other.

The transition portion 455 of the raised portion side surface protection portion 340 protects, as a portion of the housing 105 targeted for protection, portions transitioning from the raised portion end wall 137 and the pair of raised portion end side walls 139 to a raised portion end upper surface 142. That is, the transition portion 455 is formed in such a shape that the surfaces of the raised portion side surface protection portion 340 parallel with the YZ plane and the XZ plane and the surface of a raised portion upper surface protection portion 345 parallel with the XY plane are continuous to each other. The transition portion 455 of the raised portion side surface protection portion 340 can protect a connection portion (a substantially right-angled portion at which the YZ plane and the XY plane cross each other, an end wall connection portion 143) at which the raised portion end wall 137 and the raised portion end upper surface 142 in the housing 105 are connected to each other and connection portions (substantially right-angled portions at which the XZ plane and the XY plane cross each other, a first side wall connection portion 144 and a second side wall connection portion 145) at which the pair of raised portion end side walls 139 and the raised portion end upper surface 142 are connected to each other. Thus, the transition portion 455 of the raised portion side surface protection portion 340 can protect connection portions (455-1 in FIG. 4A) of the center raised portion 135 at which the YZ plane, the XY plane, and the XZ plane are connected to each other. The transition portion 455 is formed as a curved surface. As described above, as understood from FIGS. 4A, 4B, and 1C, the transition portion 455 includes the raised portion end portion transition portions 455-1, a raised portion end wall transition portion 455-2, and raised portion end side wall transition portions 455-3. The raised portion end wall transition portion 455-2 of the transition portion 455 on a raised portion end wall 137 side protects at least part of the end wall connection portion 143. The raised portion end side wall transition portions 455-3 of the transition portion 455 on a raised portion end side wall 139 side protect at least part of the first side wall connection portion 144 and the second side wall connection portion 145. The raised portion end portion transition portions 455-1 as corner portions of the transition portion 455 protect at least part of a first three-surface connection portion 187 and a second three-surface connection portion 189. The side portion 450 of the raised portion side surface protection portion 340 includes raised portion end portion side surface protection portions 450-1, a raised portion end wall side surface protection portion 450-2, and raised portion end side wall side surface protection portions 450-3. The raised portion end wall side surface protection portion 450-2 of the side portion 450 on the raised portion end wall 137 side protects at least part of the raised portion end wall 137. The raised portion end side wall side surface protection portions 450-3 of the side portion 450 on the raised portion end side wall 139 side protect at least part of the raised portion end side walls 139. The raised portion end portion side surface protection portions 450-1 as corner portions of the side portion 450 protect at least part of a first end wall side wall connection portion 146 and a second end wall side wall connection portion 147.

Figure 4C:
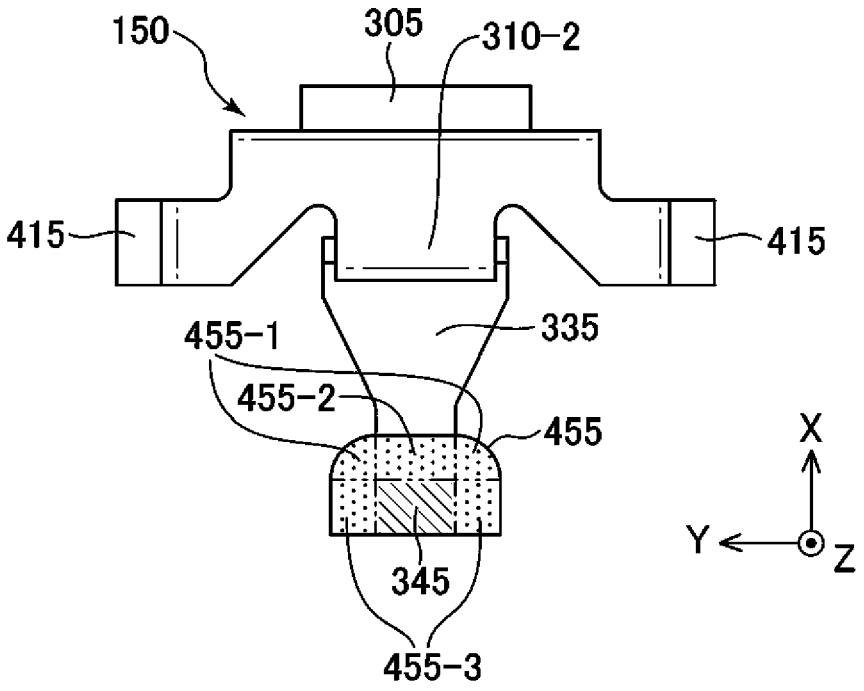
FIG. 4C is the protection member according to the first embodiment from various angles.

When the protection member 150 is viewed from above with reference to FIG. 4C, it shows that the transition portion 455 of the raised portion side surface protection portion 340 and the raised portion upper surface protection portion 345 are formed to cover an upper surface of the raised portion end upper surface 142. When the protection member 150 is viewed from below with reference to FIG. 4E, it shows that the raised portion side surface protection portion 340 and the raised portion upper surface protection portion 345 form a housing space 460 as a space for housing an end portion of the center raised portion 135. The transition portion 455 of the raised portion side surface protection portion 340 and the raised portion upper surface protection portion 345 cover at least part of the raised portion end upper surface 142 of the housing 105, and protects an upper surface of the end portion of the center raised portion 135 of the housing 105.

Referring to FIGS. 1A, 4A, and 4B, the curved holding target portion 310-2 and the side wall coupling portions 405 each protect an upper surface of the first end wall 110 or the second end wall 115 and upper surfaces of the first side wall 120 and the second side wall 125 of the housing 105, as understood from the shape of the protection member 150.

Figure 4D:
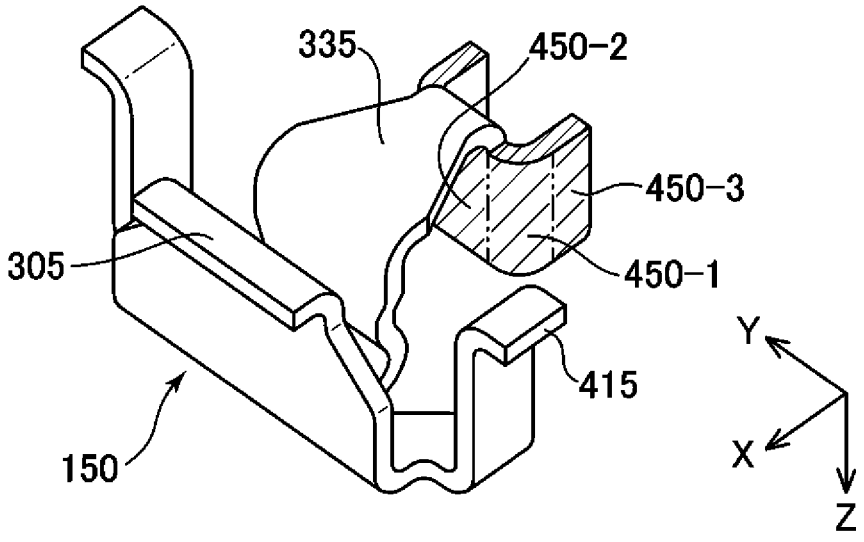
FIG. 4D is the protection member according to the first embodiment from various angles.
Figure 4E:
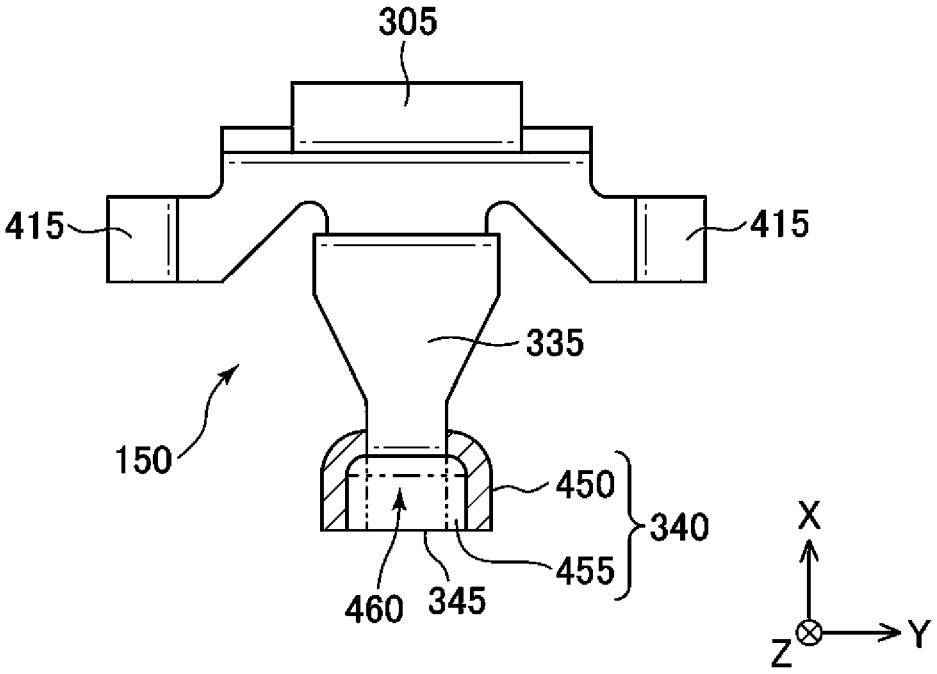
FIG. 4E is the protection member according to the first embodiment from various angles.

Referring to FIGS. 4B and 4D, the coupling portion 335 is arranged at the bottom portion of the protection member 150. The coupling portion 335 couples the holding target portion 310 to the raised portion side surface protection portion 340. In other embodiments, the coupling portion 335 may be configured to couple each side wall holding target portion 410 to the raised portion side surface protection portion 340. In this case, the coupling portion 335 is not necessarily connected to the holding target portion 310. A bottom surface of the coupling portion 335 may be arranged to face, contact, or closely contact the housing 105.

Figure 4F:
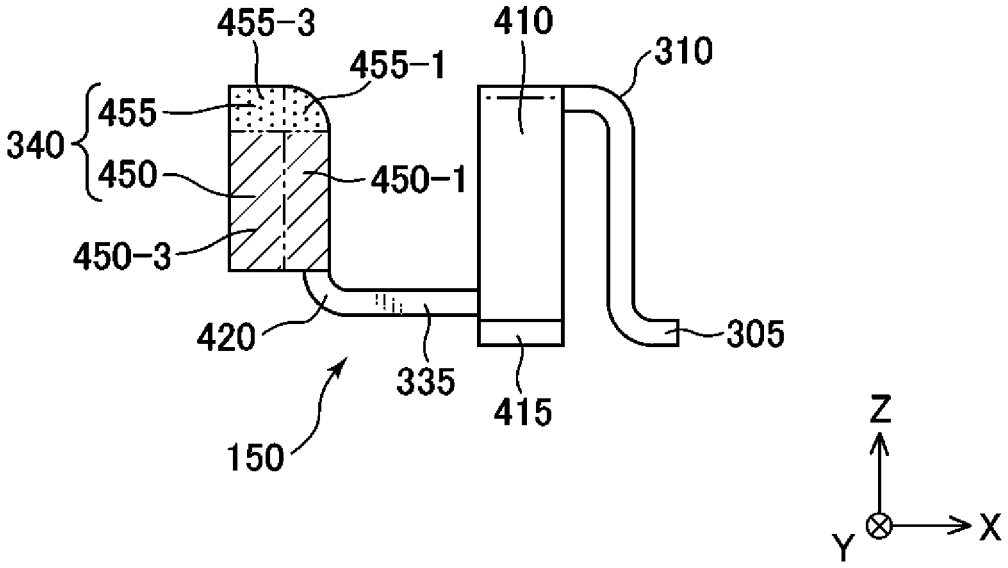
FIG. 4F is the protection member according to the first embodiment from various angles.

Referring to FIG. 4F, the coupling portion 335 has a standing portion 420, and the standing portion 420 is formed continuously to a portion of the raised portion side surface protection portion 340 on a first end wall 110 side or a second end wall 115 side of the housing 105.

Second Embodiment

A second embodiment will be described using FIGS. 5A to 5G. The second embodiment relates to a protection member 150 covering an entire end side of a center raised portion 135. FIGS. 5A to 5G show the protection member 150 from various angles. FIG. 6 shows a connector 100 according to the second embodiment. FIG. 5G is a sectional view along a line connecting characters "A" shown in FIG. 5C, and shows the protection member 150 and a housing 105 from the direction of an arrow shown in FIG. 5C. Hereinafter, differences from the first embodiment will be mainly described.

The protection member 150 according to the second embodiment has the substantially same shape as the protection member 150 according to the first embodiment, but the second embodiment and the first embodiment are different from each other in the shapes of a raised portion side surface protection portion and a raised portion upper surface protection portion. Specifically, the raised portion side surface protection portion 340 and the raised portion upper surface protection portion 345 according to the first embodiment cover only the end side of the center raised portion 135 of the housing 105 (see FIGS. 4A to 4F), but on the other hand, a raised portion side surface protection portion 540 and a raised portion upper surface protection portion 545 according to the second embodiment cover the entire end portion. In the second embodiment, the center raised portion 135 of the housing 105 has a first end portion 610 arranged in the vicinity of a first end wall 110, a second end portion 615 arranged in the vicinity of a second end wall 115, and a center portion 605 arranged between the first end portion 610 and the second end portion 615 (see FIG. 6). There are spaces forming a YZ plane between the first end portion 610 and the center portion 605 and between the second end portion 615 and the center portion 605. These spaces have a thickness in the X-direction, and such a thickness in the X-direction is equal to or greater than the thickness of a side portion 550 of the raised portion side surface protection portion 540 as described later. Thus, each of the first end portion 610 and the second end portion 615 has two side surfaces on an XZ plane and two end surfaces on the YZ plane. The two side surfaces on the XZ plane are a pair of raised portion end side walls 139. One of the two end surfaces on the YZ plane is a surface of a raised portion end wall 137, and the other end surface is a surface 580 (an inner wall of each of the first end portion 610 and the second end portion 615) facing an end surface of the center portion 605 (see FIG. 5G).

A first end wall 110 side or a second end wall 115 side of the raised portion side surface protection portion 540 is formed continuously to a holding target portion 310. The side portion 550 of the raised portion side surface protection portion 540 covers the first end portion 610 or the second end portion 615 of the center raised portion 135 of the housing 105. As seen from FIGS. 5A, 5B, 5D, and 5E, the side portion 550 of the raised portion side surface protection portion 540 covers the two side surfaces of the first end portion 610 or the second end portion 615 on the XZ plane and the two end surfaces of the first end portion 610 or the second end portion 615 on the YZ plane. The two side surfaces on the XZ plane are the pair of raised portion end side walls 139. Of the two end surfaces on the YZ plane, one end surface is the surface of the raised portion end wall 137, and the other end surface is the surface 580 (the inner wall of each of the first end portion 610 and the second end portion 615) facing the end surface of the center portion 605 (see FIG. 5G).

The side portion 550 may be curved at portions protecting portions (a first end wall side wall connection portion 146 and a second end wall side wall connection portion 147) transitioning from the raised portion end wall 137 to the pair of raised portion end side walls 139 and portions protecting portions transitioning from the pair of raised portion end side walls 139 to a surface (the surface 580 (see FIG. 5G) of the first end portion 610 or the second end portion 615 facing the end surface of the center portion 605) parallel with the raised portion end wall 137. That is, the side portion 550 is parallel with the YZ plane and the XZ plane at portions protecting the raised portion end wall 137, the pair of raised portion end side walls 139, and the surface 580 parallel with the raised portion end wall 137. Meanwhile, the side portion 550 is formed such that the direction of a plane is changed from the YZ plane to the XZ plane at the portions protecting the portions transitioning from the pair of raised portion end side walls 139 to the surface parallel with the raised portion end wall 137. Regarding such a change in the plane direction, the curve is an example, and bending at a right angle may be employed. Of the side portion 550, the portions protecting the portions transitioning from the pair of raised portion end side walls 139 to the surface parallel with the raised portion end wall 137 can protect connection portions (the first end wall side wall connection portion 146 and the second end wall side wall connection portion 147) at which the raised portion end wall 137 and the pair of raised portion end side walls 139 are connected to each other and connection portions (connection portions at which the YZ plane and the XZ plane cross each other at a substantially right angle) at which the pair of raised portion end side walls 139 and the surface 580 (see FIG. 5G) parallel with the raised portion end wall 137 are connected to each other.

Figure 5A:
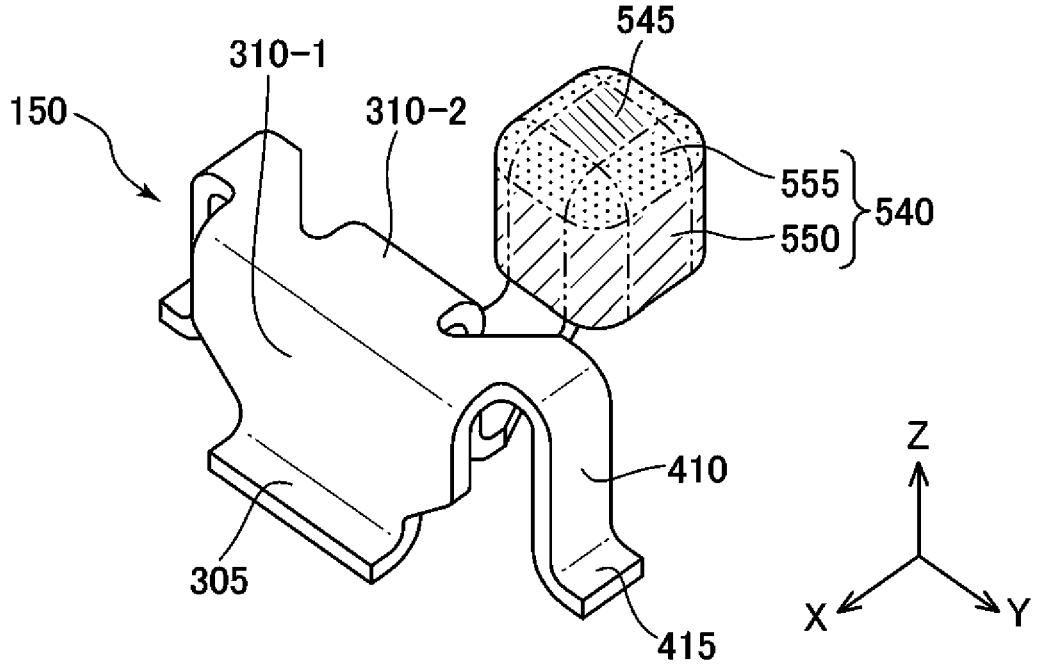
FIG. 5A is a protection member according to a second embodiment from various angles.
Figure 5B:
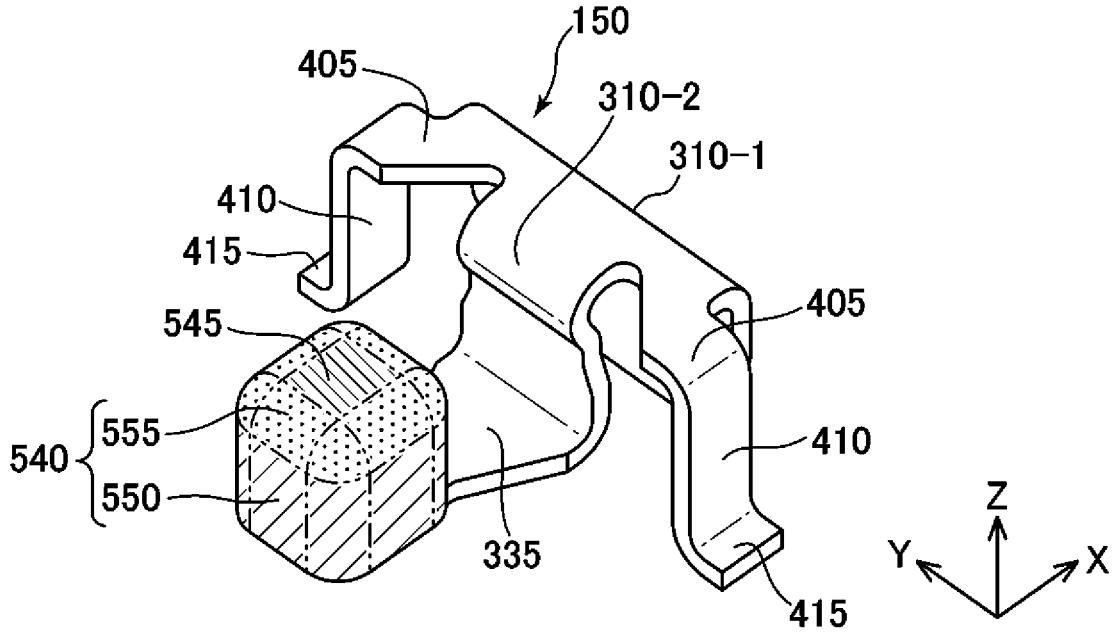
FIG. 5B is the protection member according to the second embodiment from various angles.
Figure 5C:
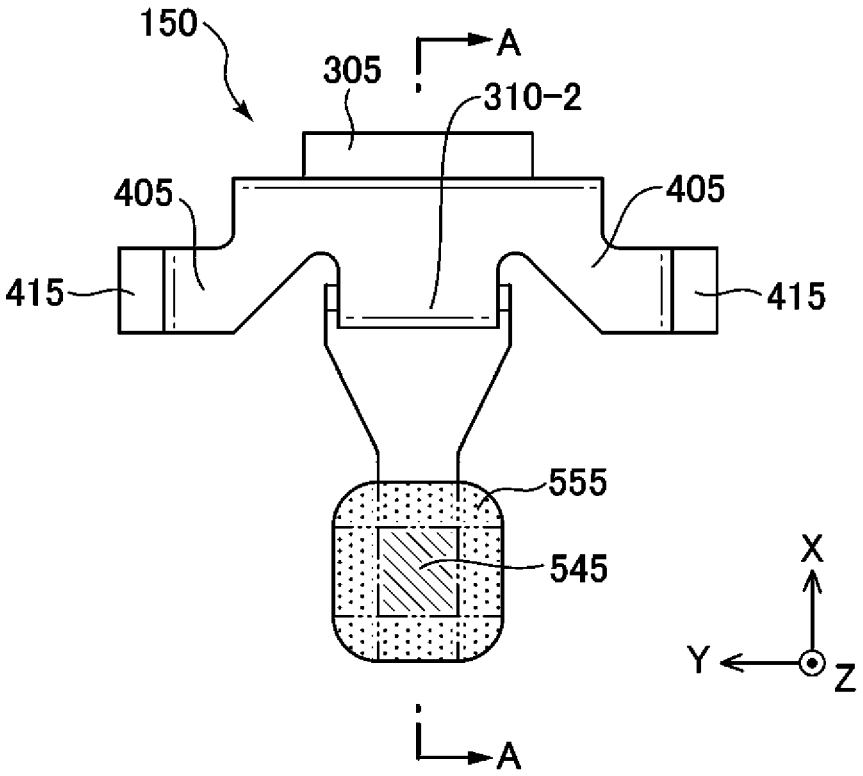
FIG. 5C is the protection member according to the second embodiment from various angles.
Figure 5D:
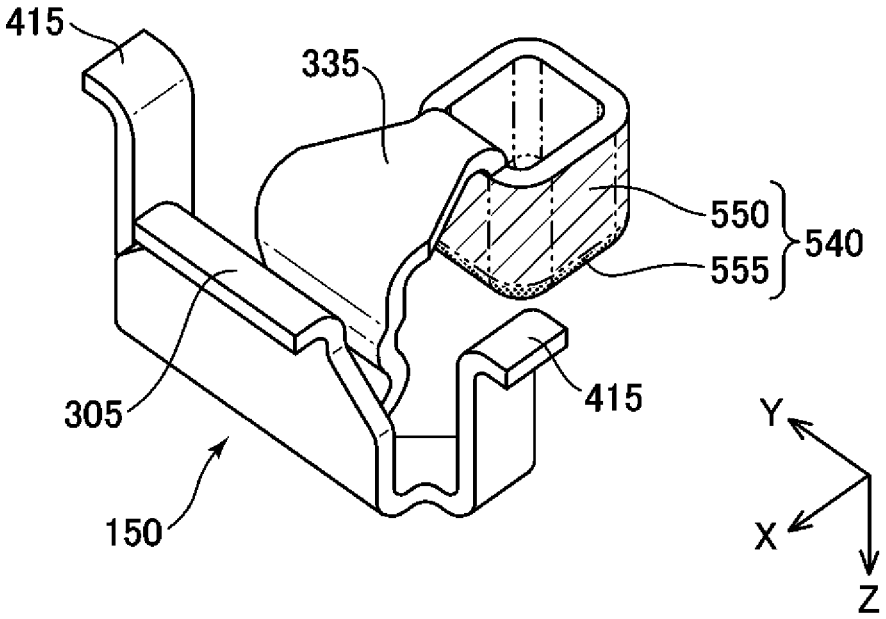
FIG. 5D is the protection member according to the second embodiment from various angles.
Figure 5E:
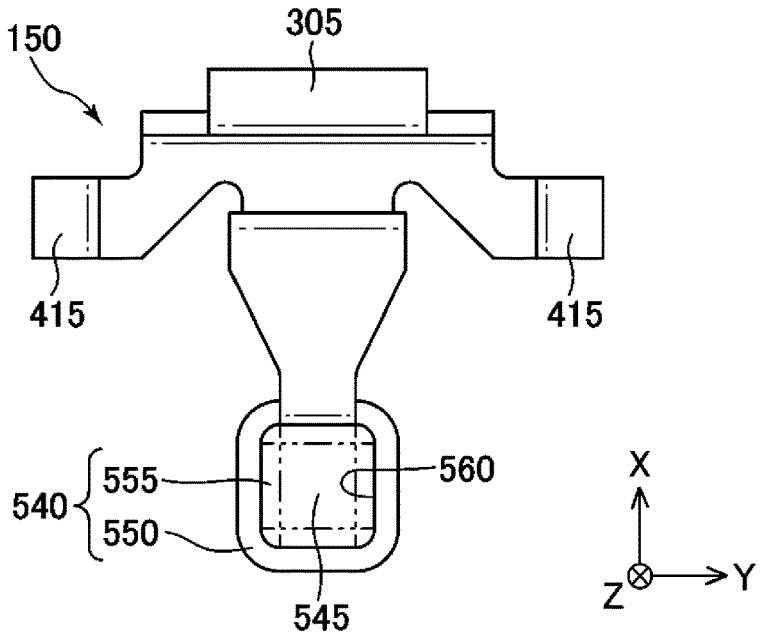
FIG. 5E is the protection member according to the second embodiment from various angles.
Figure 5F:
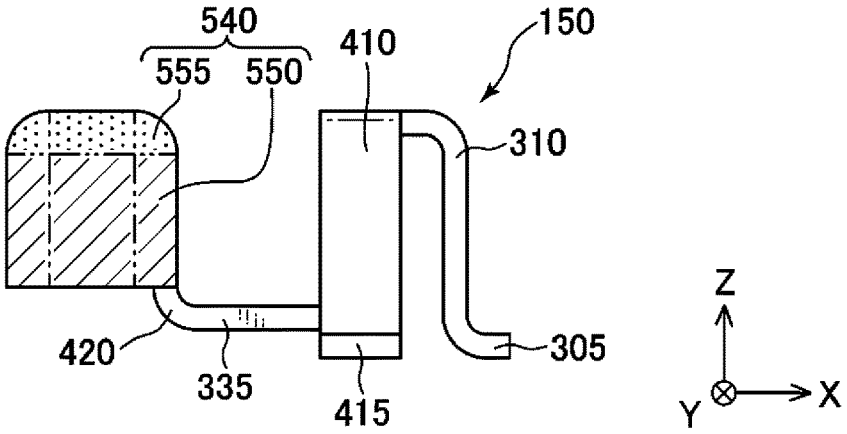
FIG. 5F is the protection member according to the second embodiment from various angles.
Figure 5G:
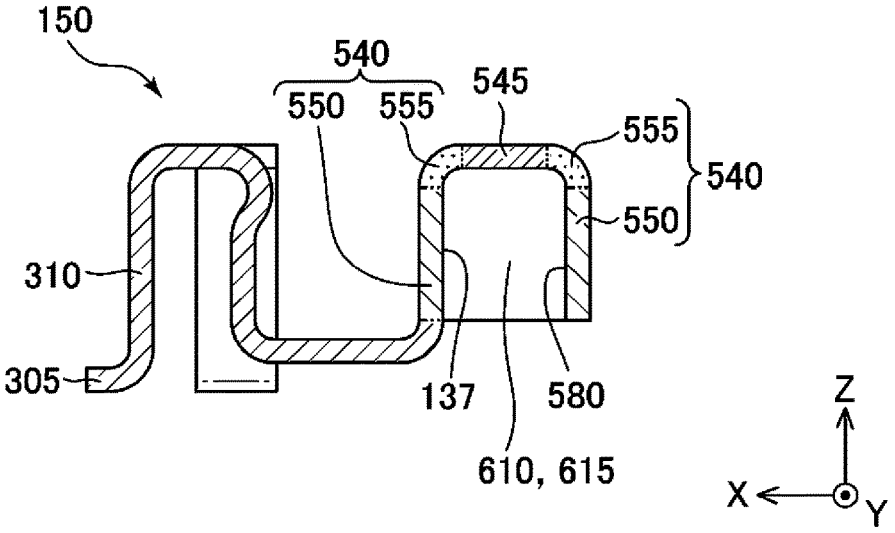
FIG. 5G is the protection member according to the second embodiment from various angles.
Figure 6:
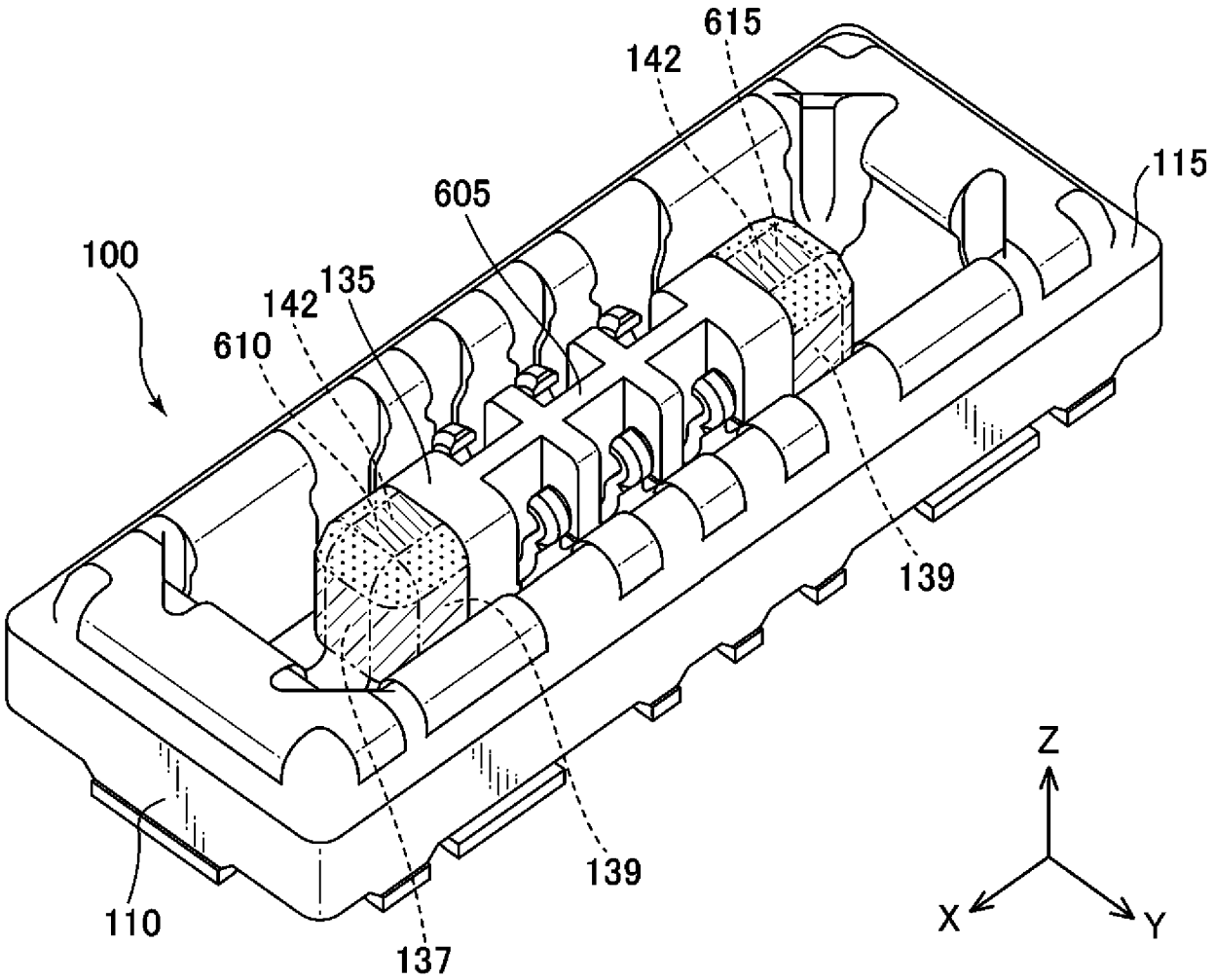
FIG. 6 is a connector according to the second embodiment.

When the protection member 150 is viewed from above with reference to FIG. 5C, it shows that a transition portion 555 and the raised portion upper surface protection portion 545 of the raised portion side surface protection portion 540 are formed so that an upper surface of a raised portion end upper surface 142 of the housing 105 can be covered with the transition portion 555 and the raised portion upper surface protection portion 545. When the protection member 150 is viewed from below with reference to FIG. 5E, it shows that the raised portion side surface protection portion 540 and the raised portion upper surface protection portion 545 form a housing space 560 as a space for housing the first end portion 610 or the second end portion 615 as the end portion of the center raised portion 135. The transition portion 555 of the raised portion side surface protection portion 540 and the raised portion upper surface protection portion 545 cover an upper surface of the first end portion 610 or the second end portion 615 in the housing 105 to protect an upper surface of the end portion of the center raised portion 135 of the housing 105.

Third Embodiment

A third embodiment will be described using FIGS. 7A to 7G. The third embodiment relates to a protection member 150 covering an end side of a center raised portion 135 and including power terminals 155. FIGS. 7A to 7G show the protection member 150 from various angles. FIG. 8 shows a connector 100 according to the third embodiment. FIG. 7G is a sectional view along a line connecting characters "A" shown in FIG. 7C, and shows the protection member 150 and a housing 105 from the direction of an arrow shown in FIG. 7C. The protection member 150 according to the third embodiment has the substantially same shape as that of the protection member 150 according to the first embodiment, but the third embodiment is different from the first embodiment in that a configuration relating to the power terminal 155 is provided. Hereinafter, differences from the first embodiment will be mainly described. Note that in the present embodiment, the power terminals 155 are described as terminals included in the protection member 150, but other terminals such as signal terminals may be provided.

Figure 7A:
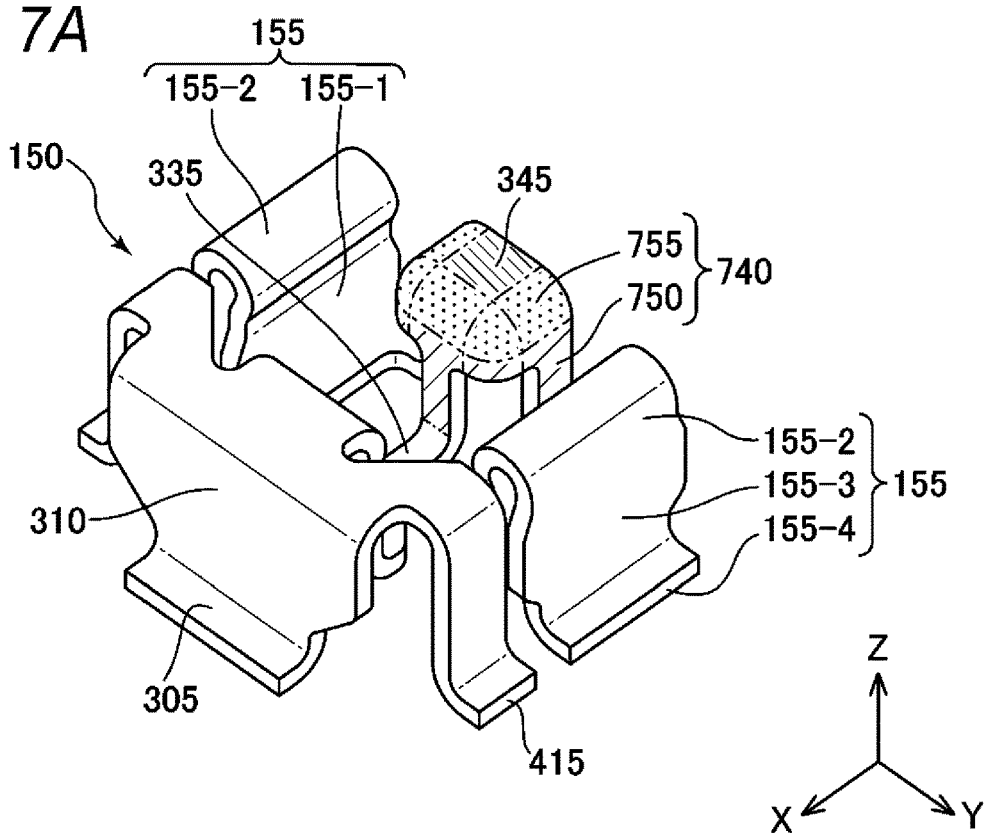
FIG. 7A is a protection member according to a third embodiment from various angles.
Figure 7B:
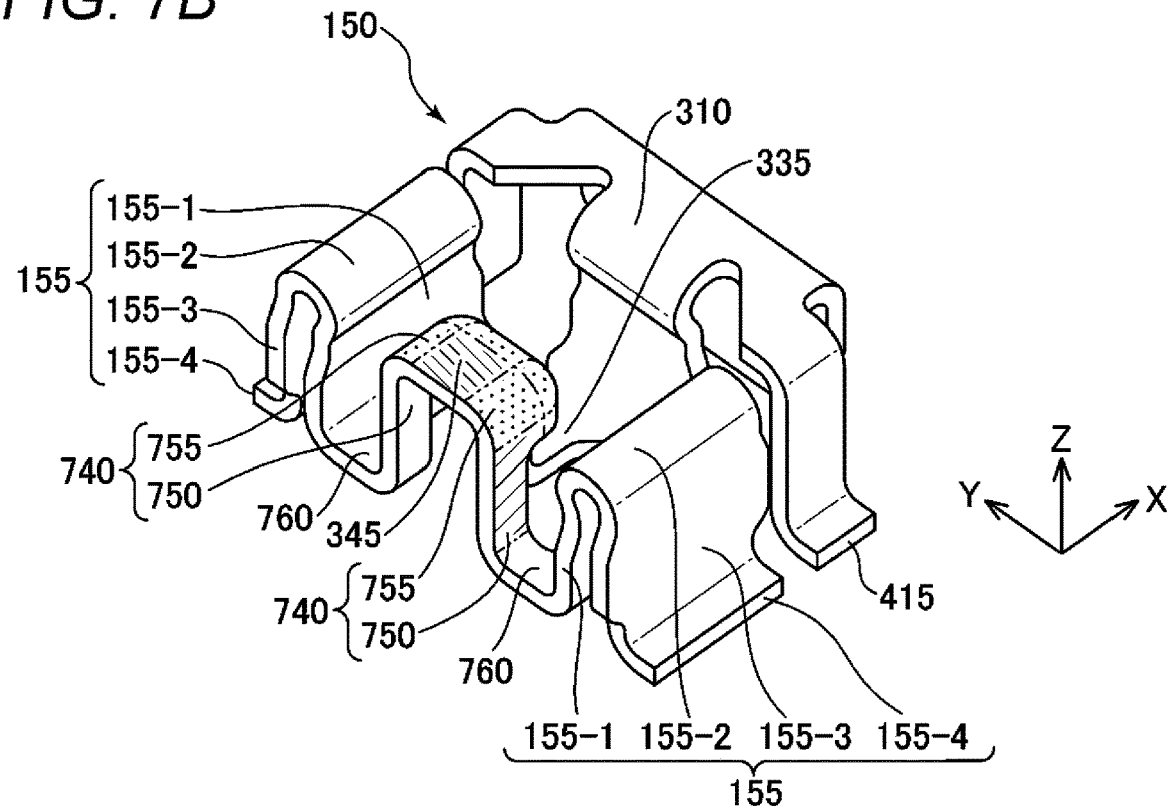
FIG. 7B is the protection member according to the third embodiment from various angles.
Figure 7C:
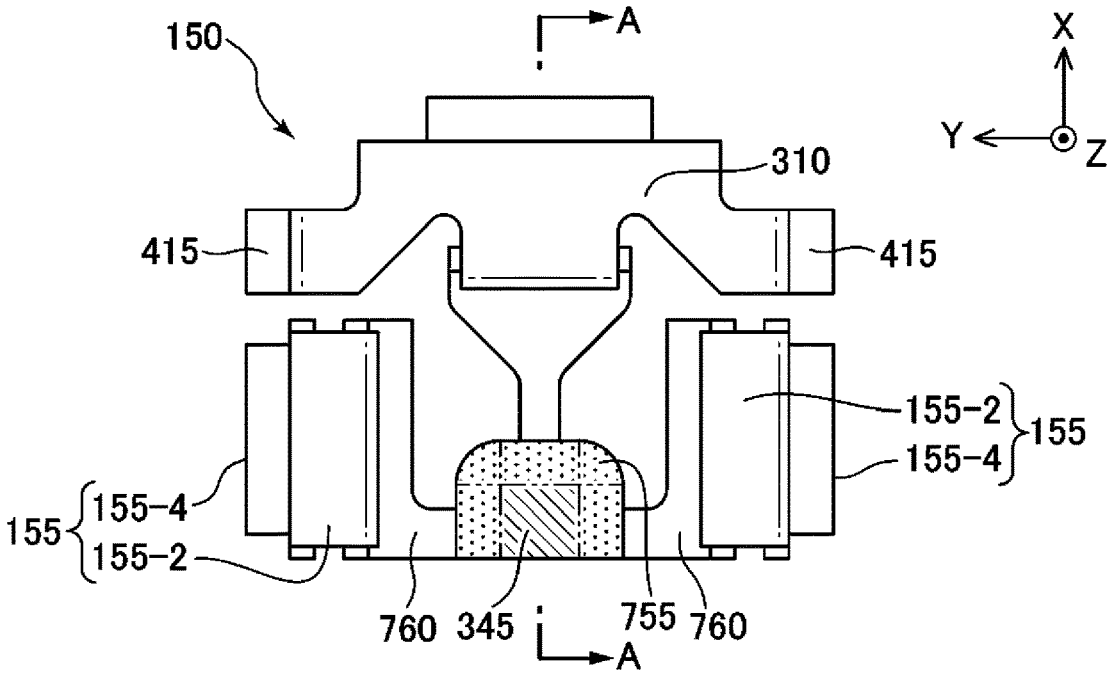
FIG. 7C is the protection member according to the third embodiment from various angles.
Figure 7D:
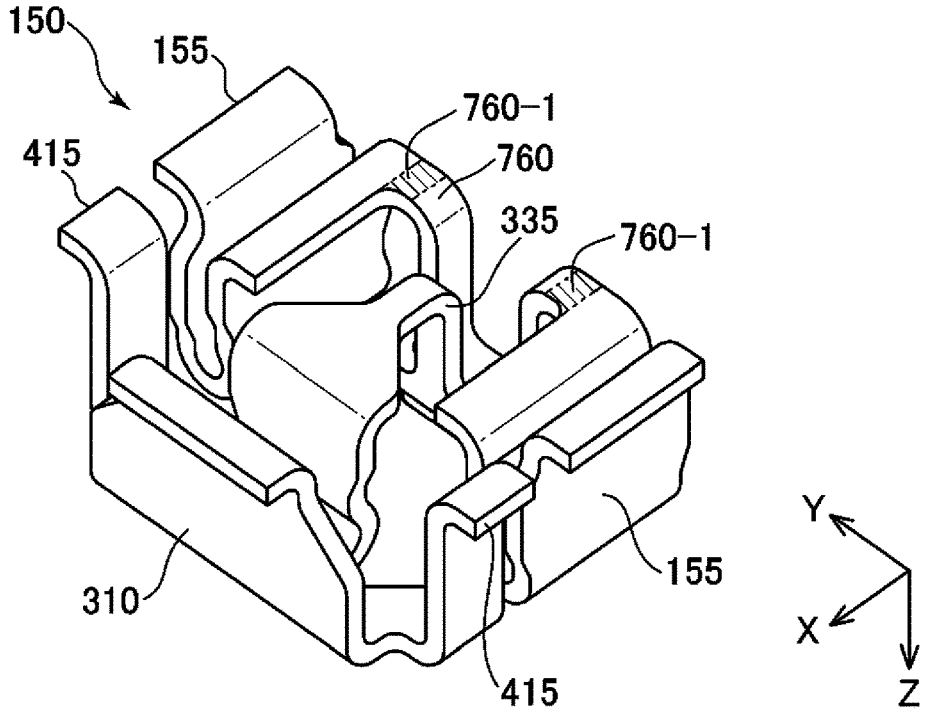
FIG. 7D is the protection member according to the third embodiment from various angles.
Figure 7E:
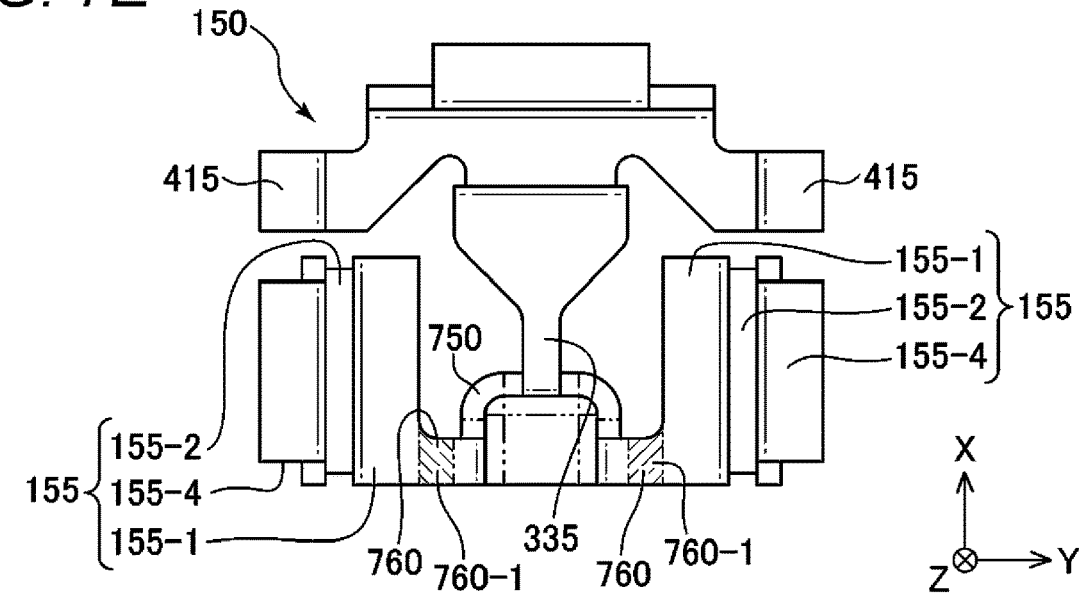
FIG. 7E is the protection member according to the third embodiment from various angles.
Figure 7F:
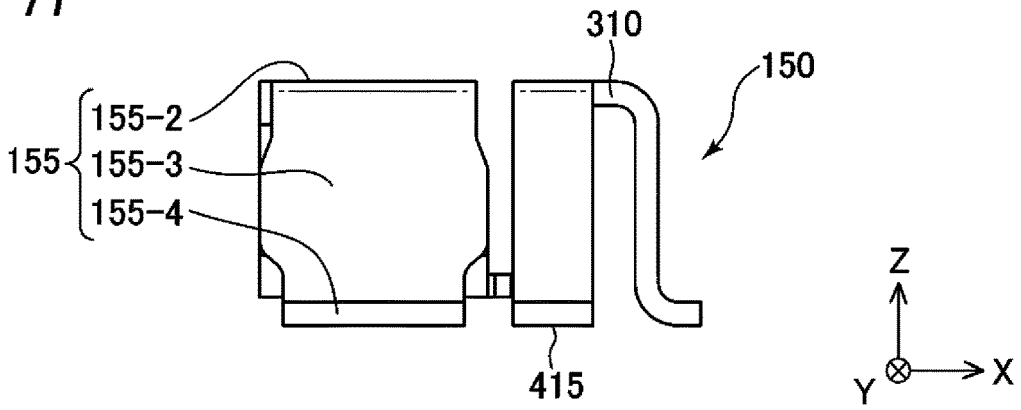
FIG. 7F is the protection member according to the third embodiment from various angles.
Figure 7G:
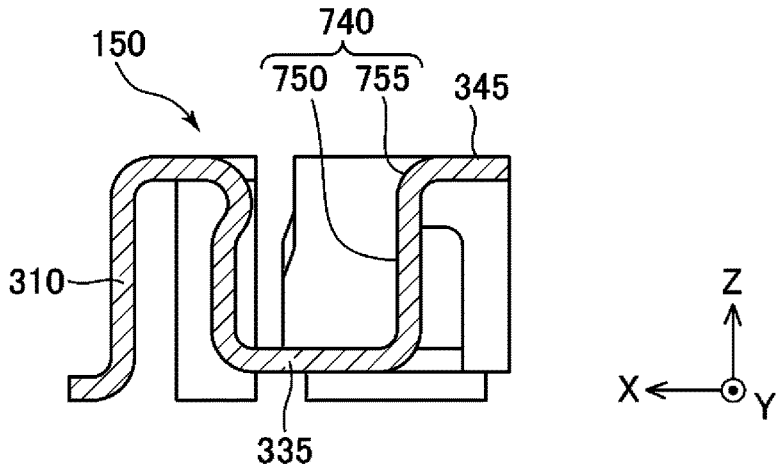
FIG. 7G is the protection member according to the third embodiment from various angles.
Figure 8:
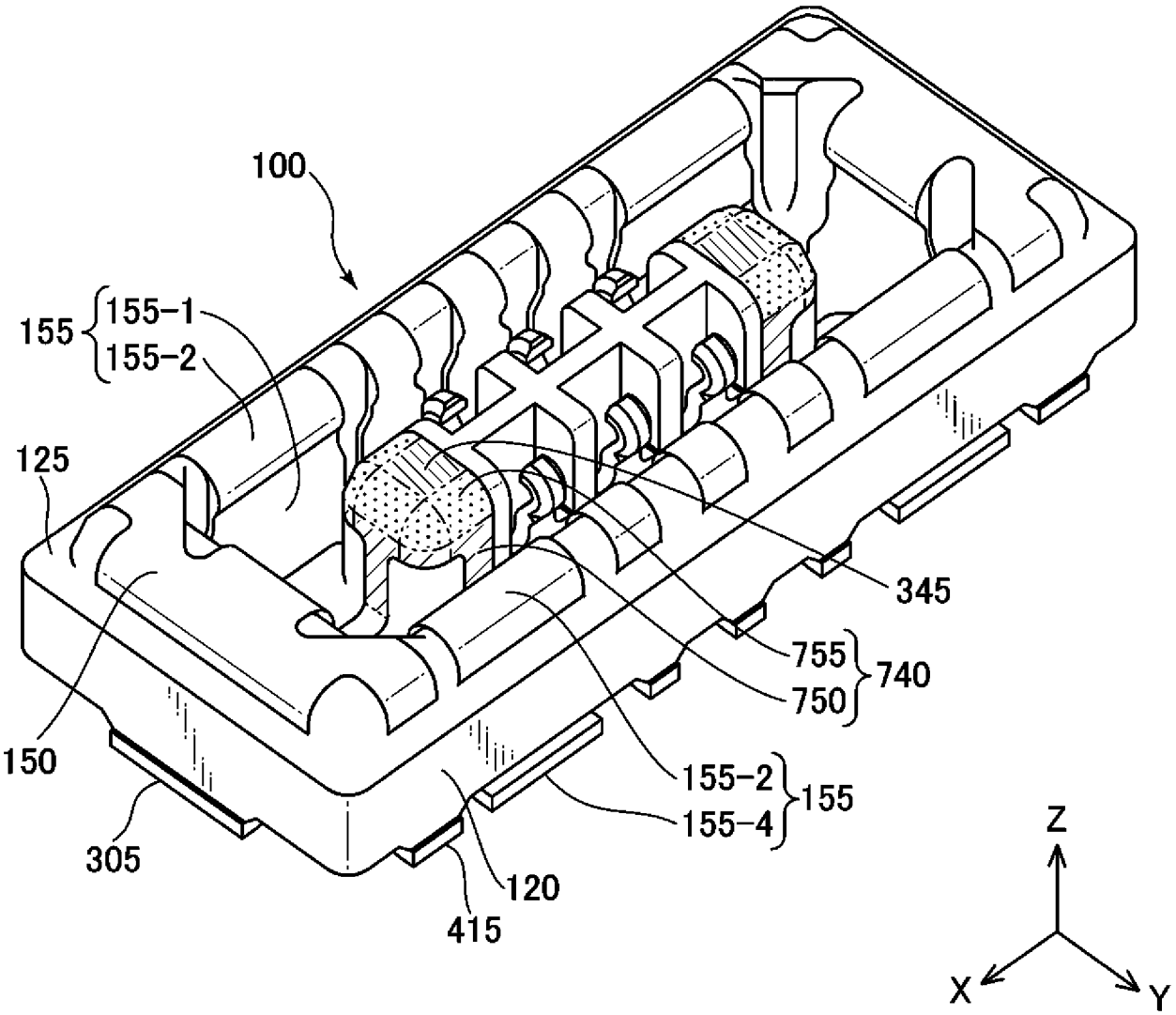
FIG. 8 is a connector according to the third embodiment.
Figure 9A:
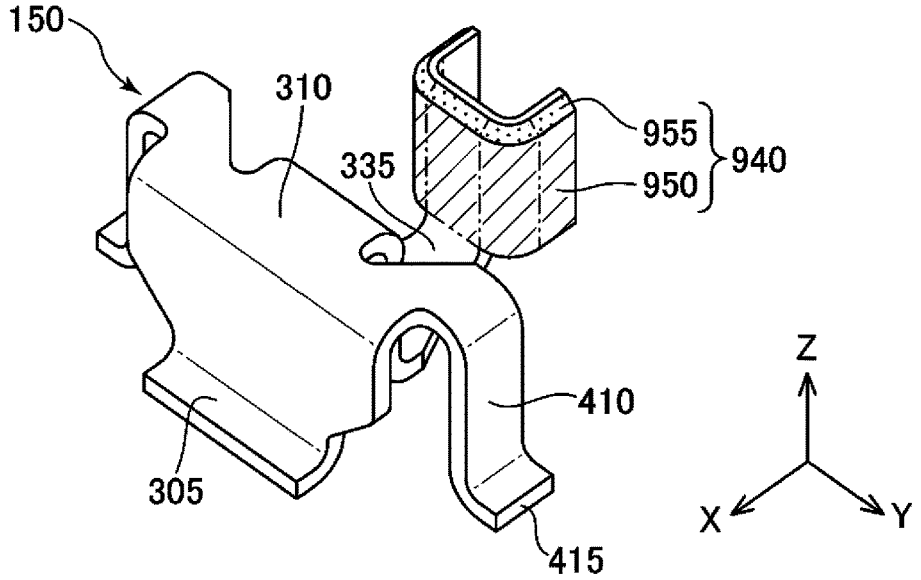
FIG. 9A is a protection member according to a fourth embodiment from various angles.
Figure 9B:
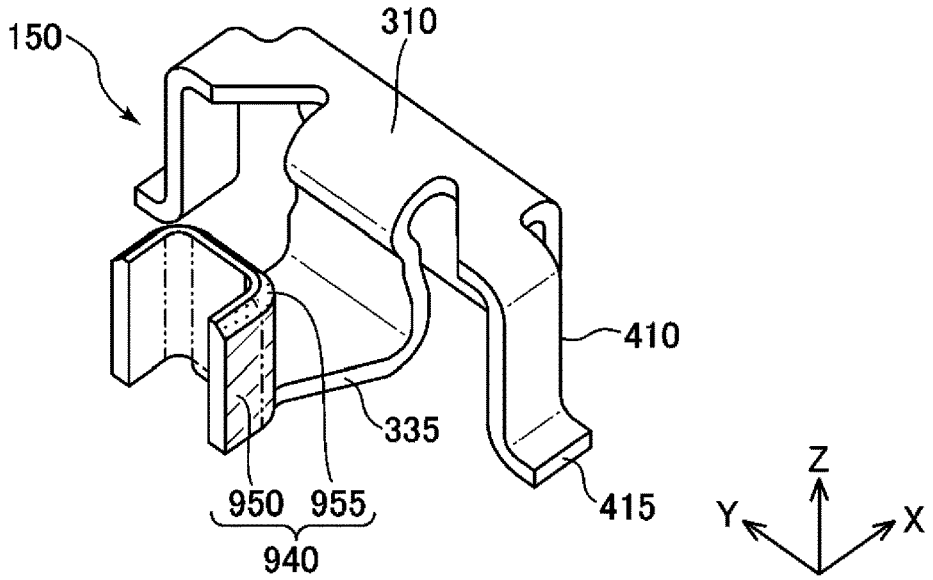
FIG. 9B is the protection member according to the fourth embodiment from various angles.
Figure 9C:
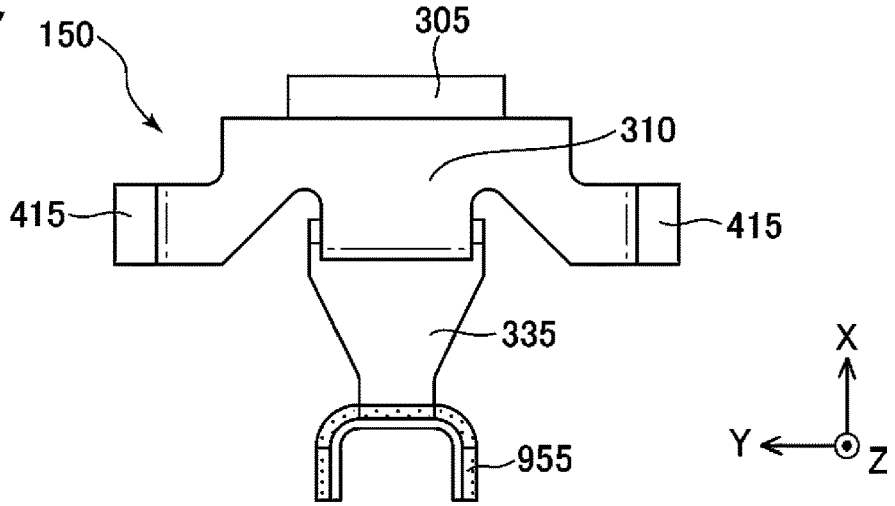
FIG. 9C is the protection member according to the fourth embodiment from various angles.
Figure 9D:
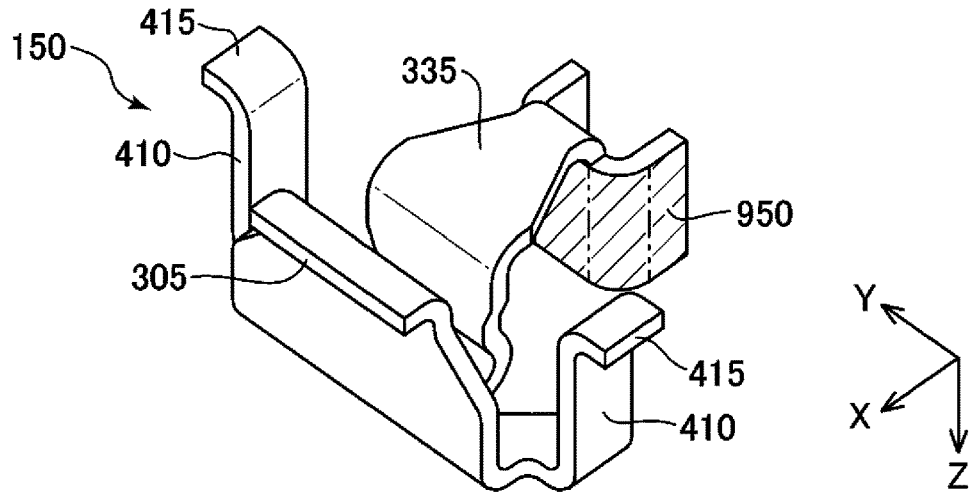
FIG. 9D is the protection member according to the fourth embodiment from various angles.
Figure 9E:
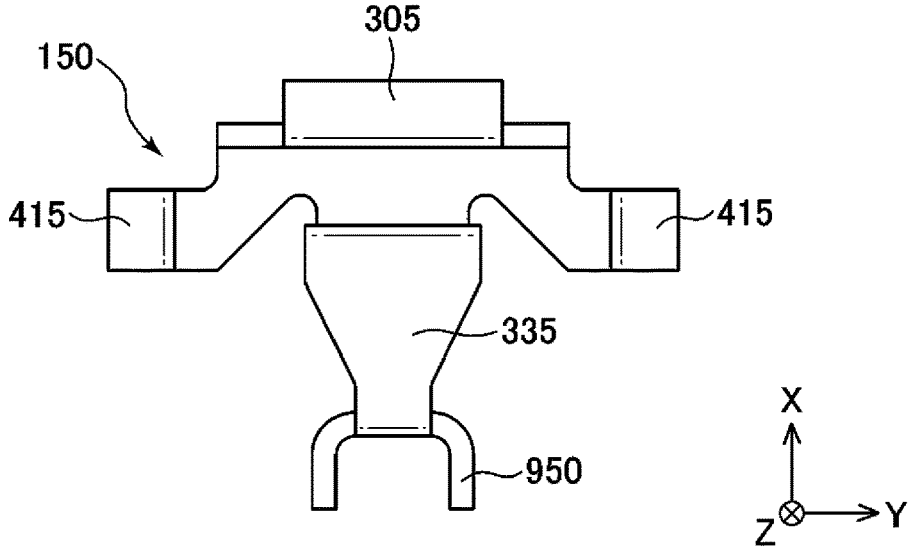
FIG. 9E is the protection member according to the fourth embodiment from various angles.
Figure 9F:
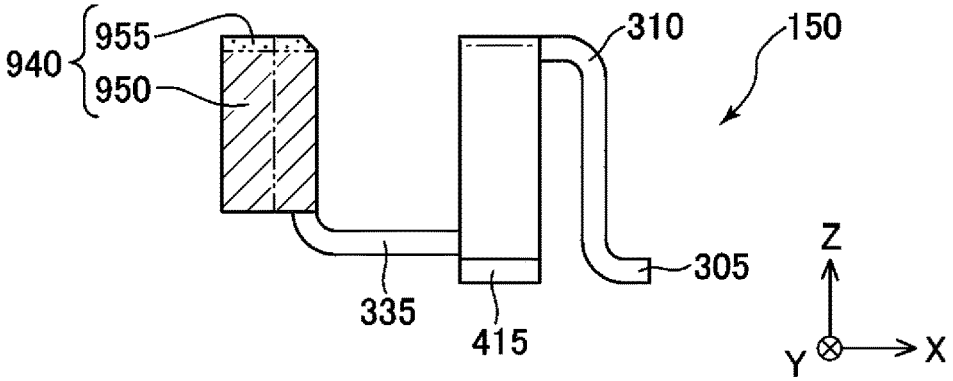
FIG. 9F is the protection member according to the fourth embodiment from various angles.

Referring to FIGS. 7A, 7B, and 7D, a holding target portion 310 is, through a coupling portion 335, formed continuously to a first end wall 110 side or a second end wall 115 side of a raised portion side surface protection portion 740. A side portion 750 of the raised portion side surface protection portion 740 covers at least part of each of a raised portion end wall 137 and a pair of raised portion end side walls 139 of the center raised portion 135 of the housing 105. As shown in FIG. 8, connection portions (a first end wall side wall connection portion 146 and a second end wall side wall connection portion 147) between the raised portion end wall 137 and each raised portion end side wall 139 have portions not covered with the protection member 150. In other embodiments, the side portion 750 may be, as in the first embodiment, configured to cover the entirety of the connection portions (the first end wall side wall connection portion 146 and the second end wall side wall connection portion 147) between the raised portion end wall 137 and each raised portion end side wall 139 and/or the entirety of the raised portion end wall 137 and the pair of raised portion end side walls 139. A transition portion 755 of the raised portion side surface protection portion 740 protects, as a target, portions (at least part of an end wall connection portion 143 and at least part of a first side wall connection portion 144 and a second side wall connection portion 145) transitioning from the raised portion end wall 137 and the pair of raised portion end side walls 139 to a raised portion end upper surface 142. The transition portion 755 of the raised portion side surface protection portion 740 can protect a connection portion (a substantially right-angled portion at which a YZ plane and an XY plane cross each other, at least part of the end wall connection portion 143) at which the raised portion end wall 137 and the raised portion end upper surface 142 are connected to each other in the housing 105 and connection portions (substantially right-angled portions at which an XZ plane and the XY plane cross each other, at least part of the first side wall connection portion 144 and the second side wall connection portion 145) at which the pair of raised portion end side walls 139 and the raised portion end upper surface 142 are connected to each other.

Referring to FIGS. 7B, 7C, 7D, and 7E, the side portion 750 of the raised portion side surface protection portion 340 is formed continuously to terminal coupling portions 760 in the vicinity of the pair of raised portion end side walls 139 of the housing 105. The terminal coupling portion 760 causes, at a bottom surface of the housing 105, a surface of the side portion 750 from the XZ plane to the XY plane, forms the XY plane, and extends in the Y-direction. With this configuration, the terminal coupling portion 760 couples the side portion 750 to the power terminal 155. A surface (760-1 in FIGS. 7D and 7E) of the terminal coupling portion 760 facing the bottom surface of the housing 105 can closely contact, contact, or face the housing 105, or can be formed by combination of two or more of the surface closely contacting, contacting, or facing the housing 105.

Referring to FIGS. 7A, 7B, and 7D, the power terminal 155 is in a substantially inverted U-shape. The power terminal 155 includes a power terminal inner holding target portion 155-1, a power terminal outer holding target portion 155-3 facing the power terminal inner holding target portion 155-1, a power terminal curved portion 155-2 coupling the power terminal inner holding target portion 155-1 and the power terminal outer holding target portion 155-3 to each other and forming a U-shaped bottom portion, and a power terminal contact portion 155-4 formed continuously to a bottom surface of the power terminal outer holding target portion 155-3. The power terminal 155 forms the XZ plane in a direction from the terminal coupling portion 760 to the outside of the connector 100. Moreover, the power terminal 155 forms the XZ plane in a direction from the power terminal contact portion 155-4 positioned at an end portion of the power terminal 155 to the inside of the connector 100.

Of the power terminal inner holding target portion 155-1, a portion facing the inside of the connector 100 is exposed through the housing 105, and a portion facing the outside of the connector 100 faces the housing 105, as seen from FIG. 8. Of the power terminal curved portion 155-2, an upper surface is exposed through the housing 105, and a bottom surface faces the housing 105. The power terminal outer holding target portion 155-3 is covered with the housing 105. Thus, at least part of the power terminal inner holding target portion 155-1, the power terminal curved portion 155-2, and the power terminal outer holding target portion 155-3 closely contacts, contacts, or faces a first side wall 120 or a second side wall 125 of the housing 105, and the protection member 150 is held on the housing 105 accordingly. In other embodiments, the power terminal 155 may have a protruding portion protruding in an inward direction of the connector 100, and may have a locking portion. The locking portions are locked at locking target portions (not shown in the figure) of a partner connector 200, and the connector 100 and the partner connector 200 are more firmly fixed to each other.

The connector 100 can be produced by insert molding. In this case, the bottom surfaces of the power terminal inner holding target portion 155-1, the power terminal outer holding target portion 155-3, and the power terminal contact portion 155-4 or part thereof is formed on the same plane as (substantially flush with) the bottom surface of the housing 105.

In other embodiments, the protection member 150 is not necessarily coupled to the power terminals 155. In this case, the protection member 150 does not have at least the terminal coupling portions 760. Further, the protection member 150 can be formed without part or the entirety of the portions of the side portion 750 of the raised portion side surface protection portion 740 connected to the terminal coupling portions 760. That is, portions of the protection member 150 corresponding to portions of the housing 105 other than a first three-surface connection portion 187 and a second three-surface connection portion 189 may be omitted. Alternatively, portions of the protection member 150 corresponding to portions of the housing 105 other than substantially right-angled portions at which the first three-surface connection portion 187, the second three-surface connection portion 189, the raised portion end wall 137, and the raised portion end upper surface 142 cross each other and substantially right-angled portions at which the pair of raised portion end side walls 139 and the raised portion end upper surface 142 cross each other.

Fourth Embodiment

Figure 10:
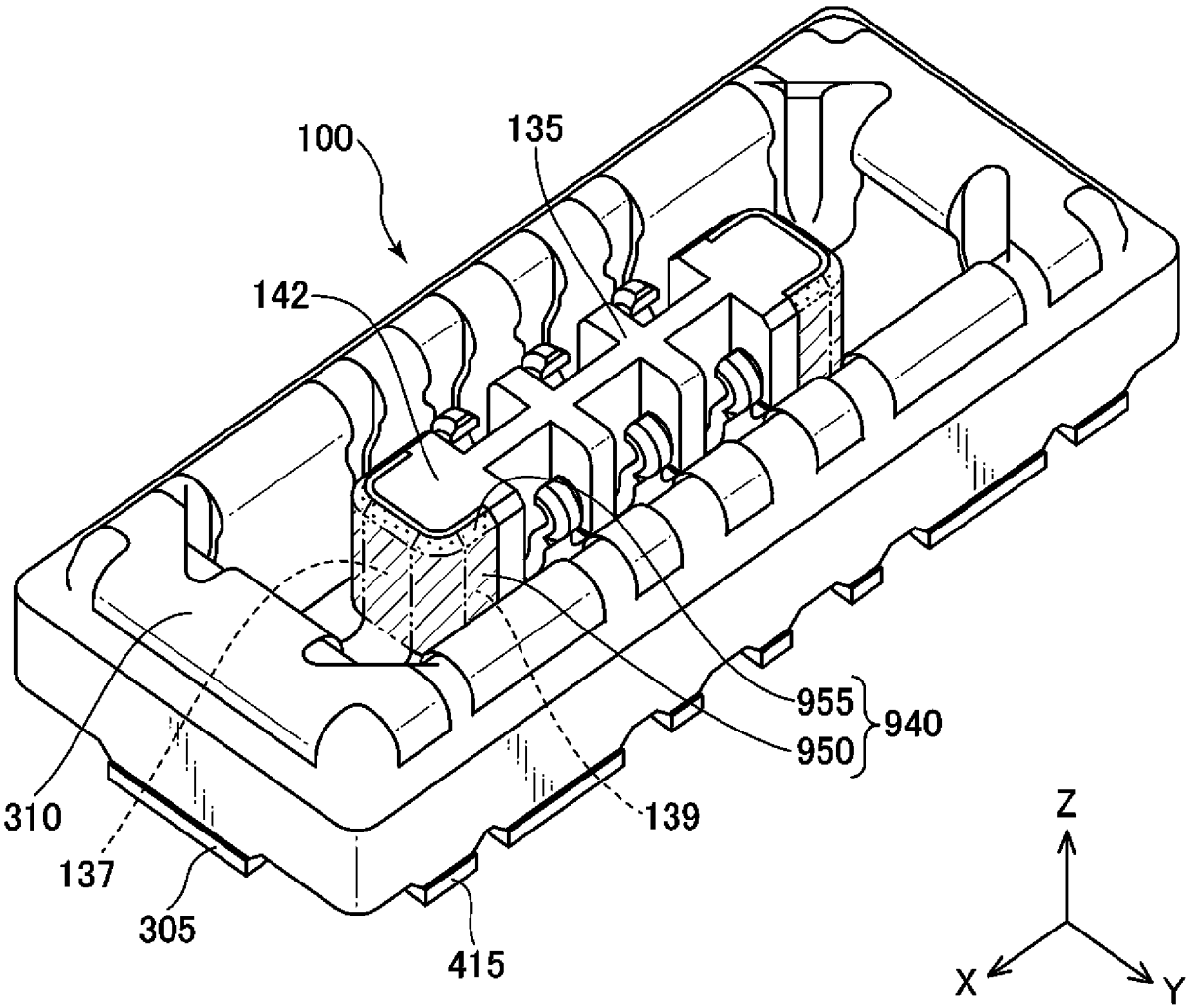
FIG. 10 is a connector according to the fourth embodiment.

A fourth embodiment will be described using FIGS. 9A to 9F. The fourth embodiment relates to a protection member 150 covering part of an upper surface of an end side of a center raised portion 135. FIGS. 9A to 9F show the protection member 150 from various angles. FIG. 10 shows a connector 100 according to the fourth embodiment. The protection member 150 according to the fourth embodiment has the substantially same shape as that of the protection member 150 according to the first embodiment, but the fourth embodiment and the first embodiment are different from each other in the shape of the protection member 150 covering part of the upper surface of the end side. Hereinafter, differences from the first embodiment will be mainly described.

The protection member 150 according to the embodiment of the present disclosure has at least a raised portion side surface protection portion 940. In other embodiments, the protection member 150 may have part of a raised portion upper surface protection portion 345 shown in, e.g., FIG. 4A. In the present embodiment, the protection member 150 partially covers the upper surface of the end side of the center raised portion 135. A side portion 950 of the raised portion side surface protection portion 940 covers at least part of each of a raised portion end wall 137 and a pair of raised portion end side walls 139 of the center raised portion 135 of the housing 105 and at least part of a first end wall side wall connection portion 146 and a second end wall side wall connection portion 147 of the center raised portion 135 of the housing 105. A transition portion 955 of the raised portion side surface protection portion 940 protects, as a target, portions transitioning from the raised portion end wall 137 and the pair of raised portion end side walls 139 to a raised portion end upper surface 142. That is, the transition portion 955 is formed in such a shape that surfaces of the raised portion side surface protection portion 940 parallel with a YZ plane and an XZ plane and a surface of the raised portion upper surface protection portion 345 parallel with an XY plane are continuous to each other. The transition portion 955 of the raised portion side surface protection portion 940 can protect a connection portion (a substantially right-angled portion at which the YZ plane and the XY plane cross each other, an end wall connection portion 143) at which the raised portion end wall 137 and the raised portion end upper surface 142 are connected to each other in the housing 105 and connection portions (substantially right-angled portions at which the XZ plane and the XY plane cross each other, a first side wall connection portion 144 and a second side wall connection portion 145) at which the pair of raised portion end side walls 139 and the raised portion end upper surface 142 are connected to each other (see FIG. 10).

In each of the above-described embodiments, the protection member 150 has the side portion and the transition portion, and therefore, can cover the three-surface connection portions (the corner portions) formed by the raised portion end wall 137, the raised portion end upper surface 142, and the pair of raised portion end side walls 139 in the housing 105, i.e., the first three-surface connection portion 187 and the second three-surface connection portion 189 (the portions corresponding to 455-1 in FIGS. 1 and 4A) formed by the connection portion (the substantially right-angled portion at which the raised portion end wall 137 and the raised portion end upper surface 142 cross each other, the end wall connection portion 143) at which the raised portion end wall 137 and the raised portion end upper surface 142 are connected to each other and the connection portions (the substantially right-angled portions at which the pair of raised portion end side walls 139 and the raised portion end upper surface 142 cross each other, the first side wall connection portion 144 and the second side wall connection portion 145) at which the pair of raised portion end side walls 139 and the raised portion end upper surface 142 are connected to each other. The first three-surface connection portion 187 and the second three-surface connection portion 189 are portions on which a load is applied most when the connector 100 and the partner connector 200 are fitted to each other, and therefore, portions which should be protected most. In the above-described embodiments of the present disclosure, the transition portion 455, 555, 755, 955 of the raised portion side surface protection portion 340, 540, 740, 940 covers the first three-surface connection portion 187 and the second three-surface connection portion 189 of the housing 105. With this configuration, the first three-surface connection portion 187 and the second three-surface connection portion 189 are properly protected. The raised portion side surface protection portion 340, 540, 740, 940 of the protection member 150 has the side portion 450, 550, 750, 950 and the transition portion 455, 555, 755, 955, and therefore, covers and protects the connection portion (the end wall connection portion 143) at which the raised portion end wall 137 and the raised portion end upper surface 142 are connected to each other and the connection portions (the first side wall connection portion 144 and the second side wall connection portion 145) at which the pair of raised portion end side walls 139 and the raised portion end upper surface 142 are connected to each other. Further, in the embodiments of the present disclosure using the raised portion upper surface protection portions 345, 545, the protection member 150 covers the raised portion end upper surface 142 of the housing 105 to protect the raised portion end upper surface 142.

The configurations of the second embodiment, the third embodiment, and the fourth embodiment can be configurations similar to that of the first embodiment. For example, the side portion 550, 750, 950 can have the raised portion end portion transition portions 455-1, the raised portion end wall transition portion 455-2, and the raised portion end side wall transition portions 455-3, and the transition portion 555, 755, 955 can have the raised portion end portion side surface protection portions 450-1, the raised portion end wall side surface protection portion 450-2, and the raised portion end side wall side surface protection portions 450-3.

In each of the above-described embodiment, the side wall coupling portion 405 couples the holding target portion 310 to the side wall holding target portion 410 along the upper surface of the housing 105, but may be configured to couple the holding target portion 310 to the side wall holding target portion 410 along the bottom surface of the housing 105. In this case, the side wall coupling portion 405 may be, as in the coupling portion 335, exposed at an upper surface of the bottom surface of the housing 105, or may be exposed at a back surface of the bottom surface of the housing 105.

A "connector width direction," a "connection depth direction," and a "connector height direction" described in the claims each correspond to the "X"-direction, the "Y"-direction, and the "Z"-direction described in the specification. Moreover, the "X"-direction and the "Y"-direction can be each referred to as a connector longitudinal direction and a connector lateral direction.

In the above-described embodiments, the connector 100 is the integrally-molded article formed of the insulating member and the conductive members forming the terminals by insert molding (integral molding). However, the connector 100 may be an integrally-molded article formed by other methods such as press-fitting.

In the above-described embodiments, the connector 100 is formed at least of the insulating member and the conductive members forming the terminals by insert molding (integral molding), but as can be understood by those skilled in the art, the connector 100 may be insert-molded (integrally molded) including a member other than the insulating member and the conductive members forming the terminals.

In the above-described embodiments, the bottom surface of the connector 100 is in the substantially rectangular shape, but such a shape is an example. The bottom surface of the connector 100 may be in other shapes such as a substantially square or a substantially triangular shape. A connector assembly is formed in a shape suitable for an electronic device for which the connector assembly is used.

In the above-described embodiments, the connector 100 and the partner connector 200 are fitted to each other so that the connector assembly can be formed. The connector assembly can be used for an electronic device equipped with a substrate with the connector assembly being connected to the substrate.

One and the other raised portion end side walls 139 described in the above-described embodiments may be referred to as a first raised portion end side wall 139 and a second raised portion end side wall 139. In this case, in the above-described embodiments, the protection member 150 covers a first connection portion between the first raised portion end side wall 139 and the raised portion end upper surface 142 and a second connection portion between the second raised portion end side wall 139 facing the first raised portion end side wall 139 and the raised portion end upper surface 142. As other embodiments, the protection member 150 may cover only one of the first connection portion or the second connection portion. In a case where the protection member 150 covers only one of the first connection portion or the second connection portion, the protection member 150 may be configured to cover only one of the first raised portion end side wall 139 or the second raised portion end side wall 139.

In the above-described embodiments, the protection member 150 is molded by, e.g., bending or pressing. In pressing, drawing is particularly preferable. It has been known that a jointless molded article can be easily produced by drawing. Thus, by drawing or other processing methods causing no joint, the protection member including the jointless raised portion side surface protection portion or the jointless raised portion side surface protection portion and raised portion upper surface protection portion.

Regarding each embodiment described above, some or all of the embodiments may be combined and implemented as a single embodiment.

The structure and arrangement of the elements of each embodiment described above are merely examples. Many modifications can be made to each embodiment by those skilled in the art. For example, these modifications include various changes in element sizes, dimensions, structures, shapes, and ratios, parameter values, attachment arrangements, used materials, colors, and orientations.

Each embodiment described above is an example for describing the present disclosure, and the present disclosure is not limited to these embodiments. The present disclosure can be implemented in various forms without departing from the gist of the present disclosure.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A connector protection member for protecting a connector, the connector including a housing having a center raised portion including at least a raised portion end wall having a plane formed by a connector depth direction and a connector height direction, a first raised portion end side wall having a plane formed by a connector width direction and the connector height direction, a second raised portion end side wall parallel with the first raised portion end side wall, and a raised portion end upper surface connecting the raised portion end wall, the first raised portion end side wall, and the second raised portion end side wall to each other and having a plane formed by the connector width direction and the connector depth direction, the connector protection member comprising:

a raised portion side surface protection portion having a side portion and a transition portion formed continuously to the side portion, wherein the side portion covers at least part of the raised portion end wall and at least part of one or both of the first raised portion end side wall and the second raised portion end side wall, and the transition portion covers at least one of a first three-surface connection portion formed by an end wall connection portion between the raised portion end wall and the raised portion end upper surface and a first side wall connection portion between the first raised portion end side wall and the raised portion end upper surface or a second three-surface connection portion formed by the end wall connection portion and a second side wall connection portion between the second raised portion end side wall and the raised portion end upper surface.

2. The connector protection member according to claim 1, wherein the transition portion of the connector protection member includes a raised portion end wall transition portion covering at least part of the end wall connection portion of the housing, and the side portion of the connector protection member includes a first raised portion end portion side surface protection portion covering at least part of a first end wall side wall connection portion connecting the raised portion end wall and the first raised portion end side wall in the housing, and a second raised portion end portion side surface protection portion covering at least part of a second end wall side wall connection portion connecting the raised portion end wall and the second raised portion end side wall in the housing.

3. The connector protection member according to claim 1, wherein the transition portion of the connector protection member includes a first raised portion end side wall transition portion covering at least part of the first side wall connection portion, and a second raised portion end side wall transition portion covering at least part of the second side wall connection portion.

4. The connector protection member according to claim 1, further comprising:

a raised portion upper surface protection portion formed continuously to the transition portion of the raised portion side surface protection portion, wherein the raised portion upper surface protection portion covers at least part of the raised portion end upper surface, and the raised portion side surface protection portion and the raised portion upper surface protection portion are formed with no joint.

5. The connector protection member according to claim 1, wherein the center raised portion has an end portion, the end portion has the raised portion end wall, the first raised portion end side wall, the second raised portion end side wall, the raised portion end upper surface, and an inner wall parallel with the raised portion end wall, and the inner wall is formed continuously to the first raised portion end side wall, the second raised portion end side wall, and the raised portion end upper surface, and the side portion of the raised portion side surface protection portion further covers at least part of the inner wall, and is formed continuously to the transition portion.

6. The connector protection member according to claim 1, further comprising:

a terminal coupling portion formed continuously to the raised portion side surface protection portion; and a terminal formed continuously to the terminal coupling portion.

7. A connector comprising:

the connector protection member according to claim 1; and the housing, wherein the housing further has a first end wall, a second end wall parallel with the first end wall, a first side wall formed continuously to the first end wall and the second end wall, and a second side wall formed parallel with the first side wall and formed continuously to the first end wall and the second end wall, a groove is formed among the first end wall, the second end wall, the first side wall, the second side wall, and the center raised portion, the connector protection member includes a holding target portion held on the first end wall, a coupling portion coupling the raised portion side surface protection portion and the holding target portion on a first end wall side, a side wall holding target portion held on the first side wall, and a side wall coupling portion coupling the holding target portion and the side wall holding target portion, and the connector protection member is insert-molded with the housing.

* * * * *